US010435231B2

(12) United States Patent
Mitten et al.

(10) Patent No.: US 10,435,231 B2
(45) Date of Patent: Oct. 8, 2019

(54) PACKAGE FOR E-KIT WITH POUCH, BLANK FOR MAKING THE PACKAGE, THE PACKAGED E-KIT WITH THE POUCH, AND METHOD OF FORMING THE E-KIT WITH THE POUCH

(71) Applicant: Altria Client Services LLC, Richmond, VA (US)

(72) Inventors: Robert T. Mitten, Glen Allen, VA (US); Scott A. Fath, Richmond, VA (US); William J. Bogdziewicz, III, Richmond, VA (US); Ryan Alan Bailey, Richmond, VA (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 303 days.

(21) Appl. No.: 15/223,811

(22) Filed: Jul. 29, 2016

(65) Prior Publication Data

US 2018/0029785 A1 Feb. 1, 2018

(51) Int. Cl.
*B65D 69/00* (2006.01)
*B65D 85/20* (2006.01)
(Continued)

(52) U.S. Cl.
CPC ..... *B65D 85/20* (2013.01); *A24F 15/12* (2013.01); *A24F 47/002* (2013.01);
(Continued)

(58) Field of Classification Search
CPC .... B65D 85/20; B65D 5/0254; B65D 5/5035; B65D 5/5088; B65D 5/5405;
(Continued)

(56) References Cited

U.S. PATENT DOCUMENTS 3,908,827 A 9/1975 Bemmels et al.
4,180,165 A 12/1979 Kuchenbecker
(Continued)

FOREIGN PATENT DOCUMENTS

JP 2007331832 A 12/2007
JP 2009255948 A 11/2009
(Continued)

OTHER PUBLICATIONS

U.S. Office Action dated Mar. 8, 2018 in related U.S. Appl. No. 29/572,709.

(Continued)

*Primary Examiner* — Luan K Bui
(74) *Attorney, Agent, or Firm* — Harness, Dickey & Pierce, P.L.C.

(57) ABSTRACT

The package includes a front panel and a back panel, a first side formed by an intermediate panel connected to the front panel and the back panel, and a second side sealed by an adhesive, where the adhesive connects a rear surface of a side panel to a front surface of a side glue panel. An upper end of the package is formed by a front upper panel connected to an upper portion of the front panel, where the upper end is sealed by a front upper tuck panel being tucked into the outer package so that a front surface of the front upper tuck panel contacts an upper portion of the back panel. The upper end is sealed by a front upper tuck panel and a back tuck panel, the back tuck panel being retained in a front upper slit defined by the front upper panel.

7 Claims, 20 Drawing Sheets

(51) Int. Cl.

| | |
|---|---|
| ***A24F 47/00*** | (2006.01) |
| ***B65D 5/02*** | (2006.01) |
| ***B65D 5/54*** | (2006.01) |
| ***B65D 77/04*** | (2006.01) |
| ***A24F 15/12*** | (2006.01) |
| ***B65D 73/00*** | (2006.01) |
| ***B65D 75/36*** | (2006.01) |
| ***B65D 5/50*** | (2006.01) |
| ***B65D 85/10*** | (2006.01) |
| ***B65D 5/66*** | (2006.01) |

(52) U.S. Cl.
CPC ..... *A24F 47/008* (2013.01); *B65D 5/0254* (2013.01); *B65D 5/5035* (2013.01); *B65D 5/5088* (2013.01); *B65D 5/5405* (2013.01); *B65D 5/6608* (2013.01); *B65D 73/0092* (2013.01); *B65D 75/367* (2013.01); *B65D 77/0433* (2013.01); *B65D 85/10* (2013.01); *B65D 85/1036* (2013.01)

(58) Field of Classification Search
CPC ..... B65D 5/6608; B65D 73/0092; B65D 75/367; B65D 77/0433; B65D 85/1036; A24F 15/12; A24F 47/002; A24F 47/008
USPC ..... 206/236–242, 461, 462, 470, 776, 778, 206/779
See application file for complete search history.

(56) References Cited

U.S. PATENT DOCUMENTS

| | | | | |
|---|---|---|---|---|
| 5,012,927 | A | 5/1991 | Borst | |
| D324,651 | S | 3/1992 | Kaneko | |
| 5,392,919 | A | 2/1995 | Passamoni | |
| 5,602,612 | A | 2/1997 | Angeli et al. | |
| 5,626,226 | A | 5/1997 | Gardiner et al. | |
| 5,967,327 | A | 10/1999 | Jones | |
| D417,391 | S | 12/1999 | Szczepanski et al. | |
| 6,298,995 | B1 | 10/2001 | Schwester | |
| 6,779,566 | B2 | 8/2004 | Engel | |
| D601,009 | S | 9/2009 | Shinn | |
| 7,621,405 | B2 | 11/2009 | Schweitzer et al. | |
| 7,650,997 | B2 | 1/2010 | Nago | |
| D654,288 | S | 2/2012 | Lecoutre | |
| 8,235,204 | B2 | 8/2012 | Loughman et al. | |
| 8,550,250 | B2 | 10/2013 | Wade | |
| 8,631,935 | B2 | 1/2014 | Tomes et al. | |
| 8,646,607 | B1 * | 2/2014 | Dana | B65D 75/22 206/461 |
| D713,740 | S | 9/2014 | Akana et al. | |
| D748,498 | S | 2/2016 | Pipes et al. | |
| 9,346,596 | B2 | 5/2016 | Hanks et al. | |
| 9,492,006 | B2 | 11/2016 | Jimenez et al. | |
| 9,527,643 | B2 | 12/2016 | Streich et al. | |
| D826,714 | S | 8/2018 | Pipes et al. | |
| D830,853 | S | 10/2018 | Mitten et al. | |
| D833,270 | S | 11/2018 | Fath et al. | |
| 2003/0159969 | A1 | 8/2003 | McMichael et al. | |
| 2003/0213725 | A1 | 11/2003 | Koike | |
| 2007/0051652 | A1 | 3/2007 | Tilton | |
| 2009/0114565 | A1 | 5/2009 | Dhuru et al. | |
| 2009/0285436 | A1 | 11/2009 | Lowry | |
| 2009/0326707 | A1 | 12/2009 | Mattila | |
| 2010/0018894 | A1 * | 1/2010 | Hession | B65D 5/52 206/765 |
| 2011/0100847 | A1 | 5/2011 | Ruth | |
| 2011/0147241 | A1 | 6/2011 | Marcinkowski | |
| 2013/0118944 | A1 | 5/2013 | Niiro et al. | |
| 2013/0140200 | A1 * | 6/2013 | Scatterday | A24F 15/00 206/265 |
| 2014/0262931 | A1 * | 9/2014 | Fath | B65D 5/425 206/752 |
| 2014/0299491 | A1 * | 10/2014 | Liu | A24F 15/18 206/236 |
| 2015/0305464 | A1 * | 10/2015 | Nelson, Jr. | A24F 47/008 206/236 |
| 2015/0342252 | A1 * | 12/2015 | Fath | B65D 5/4204 206/223 |
| 2015/0375893 | A1 | 12/2015 | Korinek | |
| 2016/0095353 | A1 * | 4/2016 | Liu | A24F 15/10 206/86 |
| 2016/0101919 | A1 | 4/2016 | Zacherle et al. | |
| 2016/0134143 | A1 * | 5/2016 | Liu | B65D 85/70 206/223 |
| 2017/0008683 | A1 * | 1/2017 | Fath | B65D 75/367 |
| 2017/0060262 | A1 | 3/2017 | Hviid et al. | |
| 2017/0127787 | A1 | 5/2017 | Trivedi et al. | |

FOREIGN PATENT DOCUMENTS

| | | | |
|---|---|---|---|
| WO | WO-2015/028814 | A1 | 3/2015 |
| WO | WO-2015088744 | A1 | 6/2015 |
| WO | WO-2016/054391 | A1 | 4/2016 |

OTHER PUBLICATIONS

PCT Communication from International Searching Authority dated Oct. 30, 2017 in related Application No. PCT/EP2017/069245.

U.S. Office Action dated Jan. 2, 2019 in related U.S. Appl. No. 29/662,193.

U.S. Office Action dated Sep. 7, 2017 in related U.S. Appl. No. 29/572,709.

International Search Report and Written Opinion thereof dated Jan. 18, 2018 for corresponding International Application No. PCT/EP2017/069245.

* cited by examiner

PACKAGE FOR E-KIT WITH POUCH, BLANK FOR MAKING THE PACKAGE, THE PACKAGED E-KIT WITH THE POUCH, AND METHOD OF FORMING THE E-KIT WITH THE POUCH

BACKGROUND OF THE INVENTION

Field of the Invention

Example embodiments relate generally to packaging for an electronic vaping (e-vaping) kit, or e-kit, capable of containing e-vaping elements including one or more pouches with consumable items, a blank for making the package, a packaged e-kit with the one or more pouches, and a method of forming the e-kit.

Related Art

Electronic vaping (e-vaping) devices may comprise one or more elements that may include any of a power section, a cartridge, and a charger. A storage, shipment and sale of elements of an e-vaping device, which may take the form of a kit, may be of significant benefit to both a seller and an adult vapor purchaser of the device.

SUMMARY OF THE INVENTION

At least one example embodiment relates to an outer package for an e-kit.

In one embodiment, the outer package includes a box structure defining an inner cavity, the box structure made from a single web of material and including, a front panel and a back panel, a first side formed by an intermediate panel that is connected to the front panel and the back panel, a second side that is sealed by a first adhesive, the first adhesive connecting a rear surface of a side panel to a front surface of a side glue panel, the side panel being connected to the front panel and the side glue panel being connected to the back panel, a lower end formed by a front lower panel and a back lower panel, the front lower panel being connected to a lower portion of the front panel and the back lower panel being connected to a lower portion of the back panel, an upper end formed by a front upper panel, the front upper panel being connected to an upper portion of the front panel, the upper end being sealed by a front upper tuck panel, the front upper tuck panel being tucked into the outer package so that a front surface of the front upper tuck panel contacts an upper portion of the back panel, the front upper tuck panel being connected to the front upper panel, the upper end being further sealed by a back tuck panel, the back tuck panel being connected to an upper portion of the back panel, the back tuck panel being retained in a front upper slit defined by the front upper panel and the front upper tuck panel.

In one embodiment, the front upper panel further defines a pair of front upper side slits on sides of the front upper slit that are diagonally oriented relative to a longitudinal length of the front upper panel, and the back tuck panel defines a pair of back top slits with downturned corners below respective lower corners of the back tuck panel, wherein the front upper side slits are configured to retain the lower corners of the back tuck panel and resist the back tuck panel from being able to be backed out of the front upper slit.

In one embodiment, the upper portion of the back panel is at least partially circumscribed by arcuate slits defined by the back panel, the upper portion being configured to be depressed so that the upper portion and the back tuck panel can be torn away from the back panel in order to allow the upper end of the outer packaging to be opened and provide an indication of tampering of the outer packaging.

In one embodiment, the lower end of the box structure is sealed by a front lower tuck panel being retained in a back bottom slit defined by the back panel and the back lower panel, the front lower tuck panel being connected to the front lower panel.

In one embodiment, the back panel further defines a pair of back lower slits on sides of the back bottom slit that are diagonally oriented relative to a longitudinal length of the back panel, and the front lower panel and front lower tuck panel define a pair of front lower slits with upturned corners above respective upper corners of the front lower tuck panel, and the back lower slits being configured to retain the upper corners of the front lower tuck panel and resist the front lower tuck panel from being able to be backed out of the back bottom slit.

At least one example embodiment relates to a blank for forming an outer package for an e-kit.

In one embodiment, the blank includes a single web of material including, a front panel connected to a back panel via an intermediate panel, a front upper panel connected to a top portion of the front panel along a first fold line, a front upper tuck panel connected to a top portion of the front upper panel along a second fold line, a side panel connected to a first side of the front panel along a third fold line, a front lower panel connected to a lower portion of the front panel along a fourth fold line, the intermediate panel connected to a second side of the front panel along a fifth fold line, the intermediate panel connected to a first side of the back panel along a sixth fold line, a side glue panel connected to a second side of the back panel along a seventh fold line, a back tuck panel extending from an upper portion of the back panel, wherein the front upper panel and front upper tuck panel define a front upper side slit, the front upper panel further defining a pair of front upper side slits on sides of the front upper slit that are diagonally oriented relative to a longitudinal length of the front upper panel, and the back tuck panel defines a pair of back top slits with downturned corners below respective lower corners of the back tuck panel.

In one embodiment, the front upper slit is configured to retain the back tuck panel, the front upper side slits being configured to retain the lower corners of the back tuck panel and resist the back tuck panel from being able to be backed out of the front upper slit if the back tuck panel has been inserted into the front upper slit during an assembly of the outer package using the blank.

In one embodiment, the upper portion of the back panel of the blank is at least partially circumscribed by arcuate slits defined by the back panel, the upper portion being configured to be depressed so that the upper portion and the back tuck panel can be torn away from the back panel, once the outer package is assembled from the blank, in order to allow the upper end of the outer packaging to be opened and provide an indication of tampering of the outer packaging.

At least one example embodiment relates to an e-kit.

In one embodiment, the e-kit includes transparent outer packaging defining an inner cavity; inner packaging within the inner cavity, the inner packaging including, a trap seal card, one or more e-vaping elements contained on a single, first side of the trap seal card, the first side of the trap seal card facing a first front panel of the outer packaging, the first side of the trap seal card being configured to display an exposed portion of each of the respective e-vaping elements.

In one embodiment, the trap seal card being configured to be extracted from the outer packaging in one unobstructed motion, once an upper end of the outer packaging is opened, the trap seal card being further configured to allow the respective exposed portion of each of the respective e-vaping elements to be grasped in order to remove the respective e-vaping element from a front of the first side of the trap seal card without a need for the e-vaping elements to be pressed through any material on the trap seal card.

In one embodiment, the e-vaping elements contained on the trap seal card can be assembled to make at least one complete e-vaping device, the trap seal card further including, at least first and second raised areas on the first side of the trap seal card that each contain at least one of the e-vaping elements, wherein the trap seal card further includes, first and second retaining structures that are each configured to retain a part of the exposed portion of the respective e-vaping elements contained within the respective first and second raised areas, a sleeve connected to the first side of the trap seal card, the sleeve containing a pouch, the pouch being one of the e-vaping elements.

In one embodiment, the trap seal card is made, in part, from a first blank that is a single web of a first material, the first blank including, a second front panel defining at least a first cut-out area and a second cut-out area, wherein a flap is connected to an end of the first cut-out area along a first fold line, the flap being the first retaining structure, a back panel connected along a vertical side of the second front panel, the single web of the first material being a heat sealed board with a heat sealable adhesive on a rear surface of the second front panel and the back panel.

In one embodiment, the trap seal card further includes, a blister made from a transparent material, a major portion of the blister being sealed between the second front panel and the back panel of the trap seal card via the heat sealable adhesive, another portion of the blister forming the first and second raised areas of the trap seal card, and the first and second raised areas project through the first and second cut-out areas of the second front panel of the trap seal card, the second raised portion of the blister including an inwardly facing indention that is the second retaining structure.

In one embodiment, the outer packaging of the e-kit is a box structure, the box structure being made from a single web of second material, the box structure including, a first front panel and a second back panel, a first side formed by an intermediate panel that is connected to the first front panel and the second back panel, a second side that is sealed by a first adhesive, the first adhesive connecting a rear surface of a side panel to a front surface of a side glue panel, the side panel connected to the first front panel and the side glue panel connected to the second back panel, a lower end formed by a front lower panel connected to a lower portion of the first front panel and a back lower panel connected to a lower portion of the second back panel, an upper end formed by a front upper panel that is connected to an upper portion of the first front panel, the upper end being sealed by a front upper tuck panel tucked into the outer package so that a front surface of the front upper tuck panel contacts an upper portion of the second back panel, the front upper tuck panel being connected to the front upper panel, the upper end being further sealed by a back tuck panel connected to an upper portion of the second back panel retained in a front upper slit that is defined by the front upper panel and the front upper tuck panel.

In one embodiment, the front upper panel further defines a pair of front upper side slits on sides of the front upper slit that are diagonally oriented relative to a longitudinal length of the front upper panel, and the back tuck panel defines a pair of back top slits with downturned corners below respective lower corners of the back tuck panel, and the front upper side slits are configured to retain the lower corners of the back tuck panel and resist the back tuck panel from being able to be backed out of the front upper slit, and the upper portion of the back panel is at least partially circumscribed by arcuate slits defined by the second back panel, the upper portion being configured to be depressed so that the upper portion and the back tuck panel can be torn away from the second back panel in order to allow the upper end of the outer packaging to be opened and provide an indication of tampering of the outer packaging.

In one embodiment, the box structure is made from a second blank that is the single web of material, the second blank including, the first front panel connected to the second back panel via the intermediate panel, the front upper panel connected to a top portion of the first front panel along a first fold line, a front upper tuck panel connected to a top portion of the front upper panel along a second fold line, the side panel connected to a first side of the first front panel along a third fold line, the front lower panel connected to a lower portion of the first front panel along a fourth fold line, the intermediate panel connected to a second side of the first front panel along a fifth fold line, the intermediate panel connected to a first side of the second back panel along a sixth fold line, the side glue panel connected to a second side of the second back panel along a seventh fold line, the back tuck panel extending from the upper portion of the second back panel, wherein the front upper panel and front upper tuck panel define a front upper side slit configured to retain the back tuck panel, the front upper panel further defines a pair of front upper side slits on sides of the front upper slit that are diagonally oriented relative to a longitudinal length of the front upper panel, the back tuck panel defines a pair of back top slits with downturned corners below respective lower corners of the back tuck panel, and the front upper side slits are configured to retain the lower corners of the back tuck panel and resist the back tuck panel from being able to be backed out of the front upper slit once the back tuck panel has been inserted into the front upper slit.

At least one example embodiment relates to a method of forming an e-kit.

In one embodiment, the method includes forming an outer packaging from a first blank made from a single web of a first material, the outer packaging having a first front panel and a first back panel, the outer packaging defining an inner cavity; forming an inner packaging from a second blank and a blister by, folding the second blank along a first fold line, the second blank including a second front panel and a second back panel, the folding causing a rear surface of the second front panel to contact a rear surface of the second back panel, assembling a trap seal card by inserting the blister between the second front panel and the second back panel of the folded second blank so that at least one raised area of the blister projects through a respective at least one cut-out area defined by the second front panel of the second blank, inserting at least one e-vaping element into the respective at least one raised area of the blister, wherein each of the e-vaping elements includes an exposed portion displayed on a single side of the trap seal card, the single side of the trap seal card being the second front panel of the trap seal card, the trap seal card configured to allow the exposed portions of each of the respective e-vaping elements to be grasped in order to remove the respective e-vaping elements from the second front panel without a need for the e-vaping elements to be pressed through any material on the trap seal card;

sliding the inner packaging into the inner cavity of the outer packaging so that the second front panel of the trap card faces the first front panel of the outer packaging, the trap seal card being configured to be extracted from the outer packaging in one unobstructed motion once an upper end of the e-kit is opened after the outer packaging is sealed; and sealing the outer packaging.

In one embodiment, the forming of the inner packaging further includes, applying a heat sealable adhesive to rear surfaces of the second front panel and the second back panel of the second blank, heating the folded second blank with the blister to adhere the rear surface of the second front panel to the rear surface of the second back panel, folding a third blank to assemble a sleeve, connecting the sleeve to the second front panel of the of the trap seal card, and inserting a pouch into the sleeve, the pouch being one of the at least one e-vaping elements, the trap seal card including at least one retaining structure to retain a part of the exposed portion of each of the respective e-vaping elements contained within each of the raised areas.

In one embodiment, the method further includes providing the first blank, the first material of the first blank being a transparent material, the first blank including, the first front panel connected to the first back panel via an intermediate panel, a front upper panel connected to a top portion of the first front panel along a first fold line, a front upper tuck panel connected to a top portion of the front upper panel along a second fold line, a side panel connected to a first side of the first front panel along a third fold line, a front lower panel connected to a lower portion of the first front panel along a fourth fold line, the intermediate panel connected to a second side of the first front panel along a fifth fold line, the intermediate panel connected to a first side of the first back panel along a sixth fold line, a side glue panel connected to a second side of the first back panel along a seventh fold line, a back tuck panel extending from the upper portion of the first back panel, wherein the front upper panel and front upper tuck panel define a front upper side slit configured to retain the back tuck panel, the front upper panel further defining a pair of front upper side slits on sides of the front upper slit that are diagonally oriented relative to a longitudinal length of the front upper panel, the back tuck panel defining a pair of back top slits with downturned corners below respective lower corners of the back tuck panel, wherein the front upper side slits are configured to retain the lower corners of the back tuck panel and resist the back tuck panel from being able to be backed out of the front upper slit once the back tuck panel has been inserted into the front upper slit.

In one embodiment, the forming of the outer packaging from the first blank further includes, folding the first blank to cause a rear surface of the first front panel to face a rear surface of the first back panel, connecting a front surface of the side glue panel to a rear surface of the side panel, sealing a bottom end of the outer packaging by inserting the front lower tuck panel into a back bottom slit defined by the first back panel and the back lower panel so that upper ends of the front lower tuck panel pass through a pair of back lower slits defined by the first back panel on sides of the back bottom slit, sealing a top end of the outer packaging by inserting the back tuck panel into the front upper slit so that the lower corners of the back tuck panel pass through the front upper side slits, wherein the upper portion of the first back panel is at least partially circumscribed by arcuate slits defined by the first back panel, the upper portion being configured to be depressed so that the upper portion and the back tuck panel can be torn away from the first back panel in order to allow the upper end of the outer packaging to be opened and provide an indication of tampering of the outer packaging.

DETAILED DESCRIPTION

Figure 1:
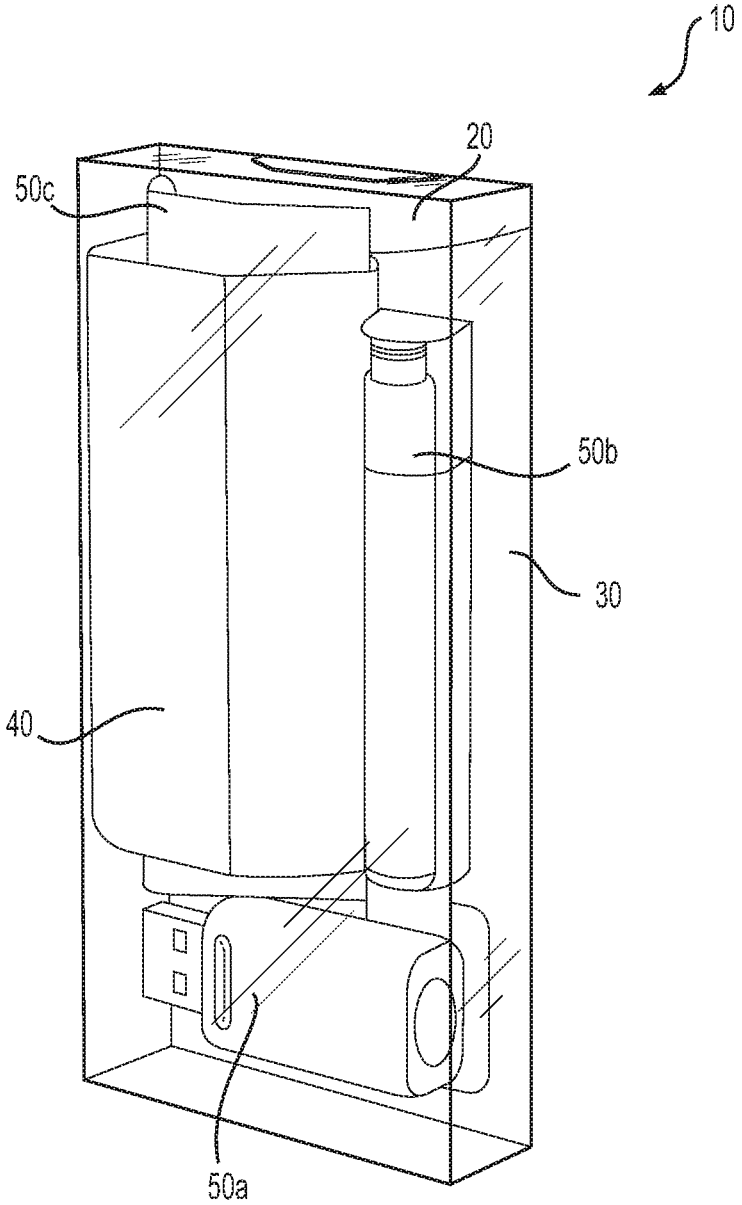
FIG. 1 is an illustration of a fully assembled and packaged electronic-vaping (e-vaping) kit, or e-kit, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, items, regions, layers and/or sections, these elements, items, regions, layers, and/or sections should not be limited by these terms. These terms are only used to distinguish one element, item, region, layer, or section from another region, layer, or section. Thus, a first element, item, region, layer, or section discussed below could be termed a second element, item, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or items, but do not preclude the presence or addition of one or more other features, integers, steps, operations, elements, items, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

When the word "about" is used in this specification in connection with a numerical value, it is intended that the associated numerical value includes a tolerance of ±10% around the stated numerical value (or range of values). Moreover, when reference is made to percentages in this specification, it is intended that those percentages are based on weight (i.e., weight percentages). The expression "up to" includes amounts of zero to the expressed upper limit and all values therebetween. When ranges are specified, the range includes all values therebetween such as increments of 0.1%.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

FIG. 1 is an illustration of a fully assembled and packaged electronic-vaping (e-vaping) kit 10, or e-kit, in accordance with an example embodiment. The kit 10 may include outer packaging 20 (also shown in FIG. 15). The outer packaging 20 may be a box-shaped structure that may envelope inner packaging (shown in detail in FIG. 12) that may include a trap seal card 30 with a paperboard sleeve 40 (also see FIG. 10). E-vaping elements 50*a-c* may be contained within the inner packaging, where the elements 50*a-c* may include, for example: a universal serial bus (USB) charger 50*a*, an e-vaping power section 50*b*, and a foil pouch 50*c* that may contain an e-vaping cartridge (or, another perishable e-vaping element).

Figure 2:
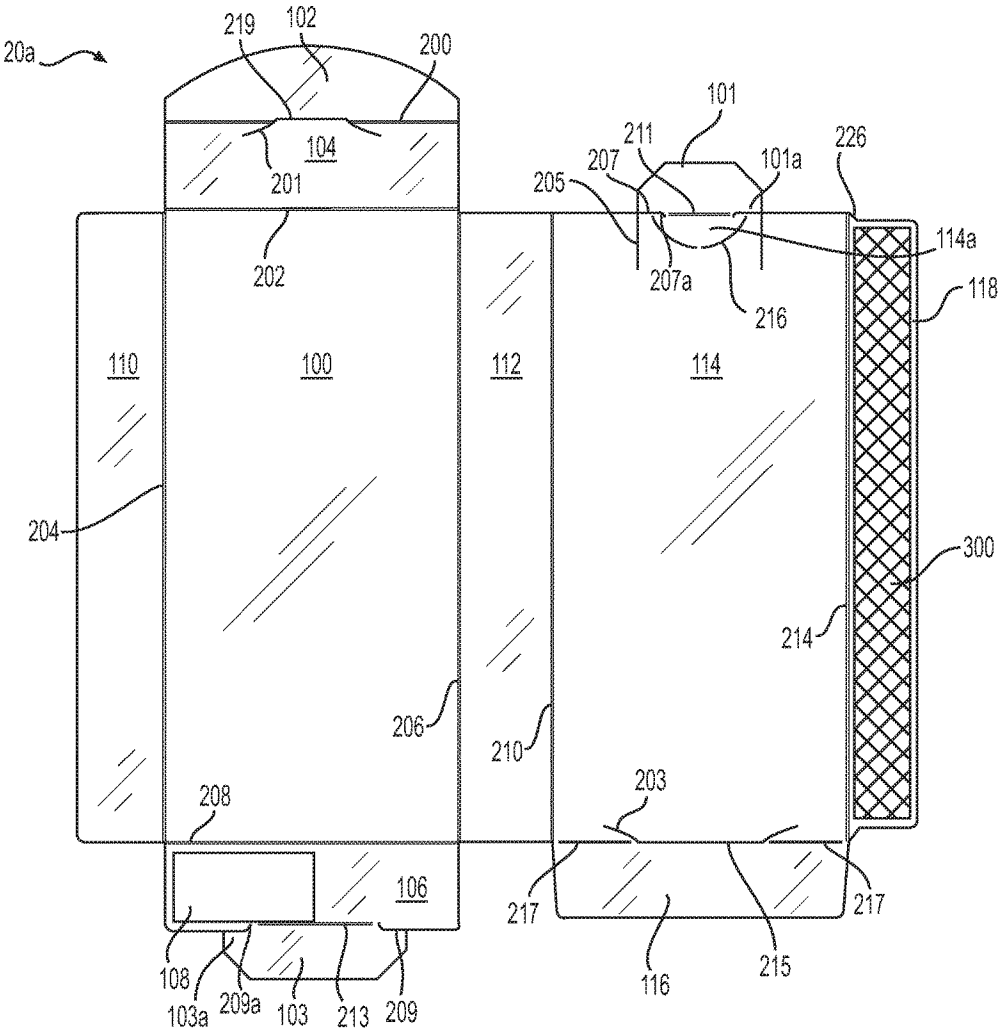
FIG. 2 is an illustration of the blank for forming outer packing of the e-kit, in accordance with an example embodiment.

FIG. 2 is an illustration of a blank 20*a* for forming the outer packing 20 of the e-kit 10, in accordance with an example embodiment. The blank 20*a* may be a single web of material made from a translucent substance, such as a plastic. Specifically, the blank 20*a* may be made from polyethylene terephthalate (PET). The blank 20*a* may include two major portions that may be a front panel 100 and a back panel 114. The front panel 100 may include a front upper panel 104 near an upper portion of the front panel 100, where a first fold line 202 may divide the front upper panel 104 from the front panel 100. The front panel 100 may also include a front upper tuck panel 102 connected to the front upper panel 104, where a second fold line 200 may divide the front upper panel 104 from the front upper tuck panel 102. A pair of front upper side slits 201 may be on either side of a front upper slit 219, where the slit 219 runs across a portion of the second fold line 200. The slits 201 may be diagonally positioned relative to a longitudinal length of the front upper panel 104 so that the bottom corners 101*a* of the back tuck panel 101 may be retained by the front upper side slits 201 when the back tuck panel is inserted into the front upper slit 219. By retaining the bottom corners 101*a* of the back tuck panel 101, the back tuck panel 101 may be locked in place within the front upper slit 219 so that the back tuck panel 101 is unable to be backed out of the front upper slit 219.

The front panel 100 may also include a side panel 110 running along a vertical side of the front panel 100, where a third fold line may divide the front panel 100 from the side panel 110.

The front panel 100 may also include a front lower panel 106 on a lower portion of the front panel 100, where a fourth fold line 208 may divide the front panel 100 from the front lower panel 106. The front lower panel 106 may include a designated 'date code area' 108 that may accept black ink lettering and may provide date information pertaining to a manufacturing date of the kit 10 (for instance). A front lower tuck panel 103 may be connected to a lower portion of the front lower panel 106, where a front lower score line 213 divides the front lower panel 106 from the front lower tuck panel 103. Two pair of front lower slits 209 may run somewhat parallel to the front lower score line 213, where the slits 209 may include upturned corners 209*a* near the front lower score line 213.

An intermediate panel 112 may be positioned between the front panel 100 and the back panel 114. A fifth fold line 206 may divide the intermediate panel 112 from the front panel, and a sixth fold line 210 may divide the back panel 114 from the intermediate panel 112.

Figure 19:
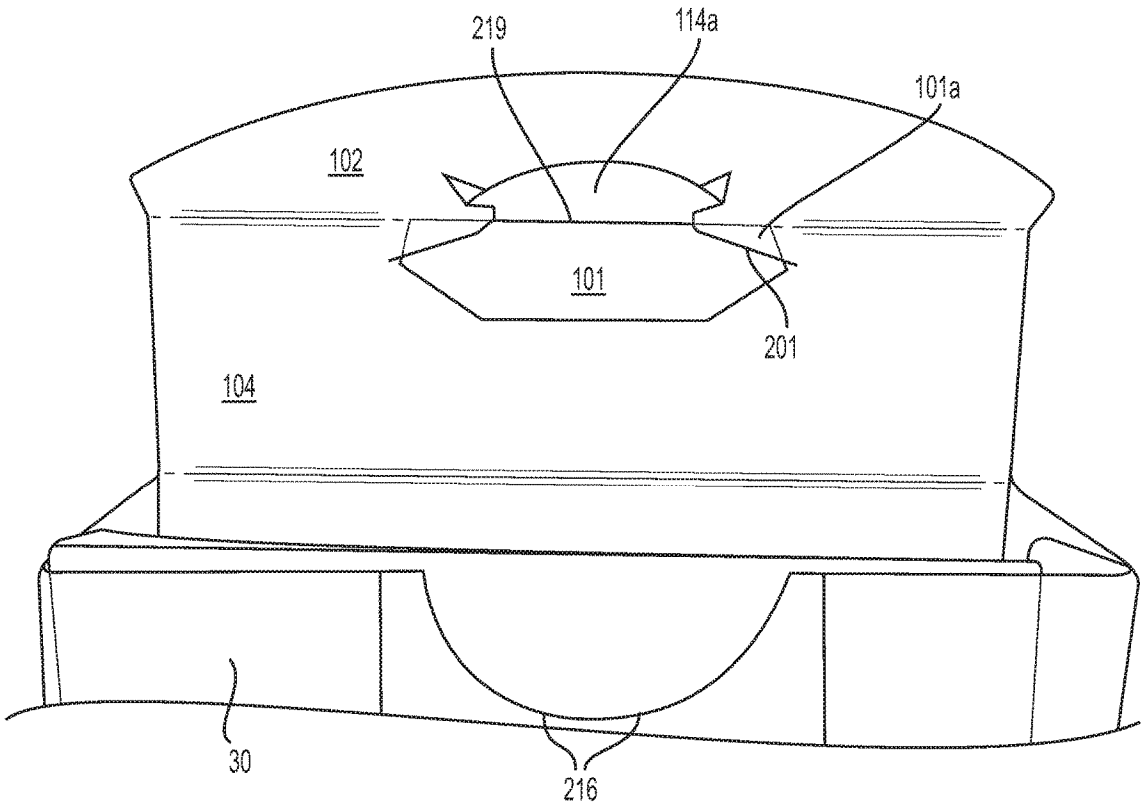
FIG. 19 is an illustration of an opened top end of the e-kit, in accordance with an example embodiment.

The back panel may include a side glue panel 118 on the free, vertical side of the back panel 114. The side glue panel 118 may include a side glue area 300 on the panel 118. A seventh fold line 214 may divide the back panel 114 from the side glue panel 118. A back tuck panel 101 may be located in an upper portion of the back panel 114, where a back upper score line 211 may divide the back panel 114 from the back tuck panel 101. A pair of back top slits 207 may be on either side of the back tuck panel 101, where downturned corners 207*a* may be on ends of the slits 207. Back side slits 205 may also be defined by the back panel 114, where the slits 205 may emanate from the sides of the back tuck panel 101 (e.g., the slits 205 may be in-line, or collinear, with the sides of the back tuck panel 101). Two arcuate slits 216 may at least partially circumscribe an upper portion 114*a* of the back panel 114 (located below the back tuck panel 101). Once the outer packaging 20 is assembled and sealed on the top end, the upper portion 114*a* may be depressed to "tear away" the upper portion 114*a* and the back tuck panel 101 from the remainder of the back panel 114 when the e-kit 10 is opened (as shown in FIG. 19, and as described below in detail). This "tear away," or "tear open" feature of the upper portion 114*a* and back panel 101, may provide an indication of tampering of the outer packaging 20. That is to say, the "tear open" feature may provide a measure of tamper resistance for the outer packaging 20.

A back lower panel may be included on a lower portion of the back panel 114. A pair of back lower score lines 217 and a back bottom slit 215 may divide the back lower panel 116 from the back panel 114. A pair of back lower slits 203 may be defined by the back panel 114 on either side of the back bottom slit 215. The back lower slits 203 may be diagonally oriented relative to a longitudinal length of the back panel 114, in order to allow the back lower slits 203 to catch the upper corners 103*a* of the front lower tuck panel 103 once the front lower tuck panel 103 is inserted into the back bottom slit 215, so as to lock the front lower tuck panel 103 into place and resist a removal of the front lower tuck panel 103 from the back bottom slit 215.

Figure 3:
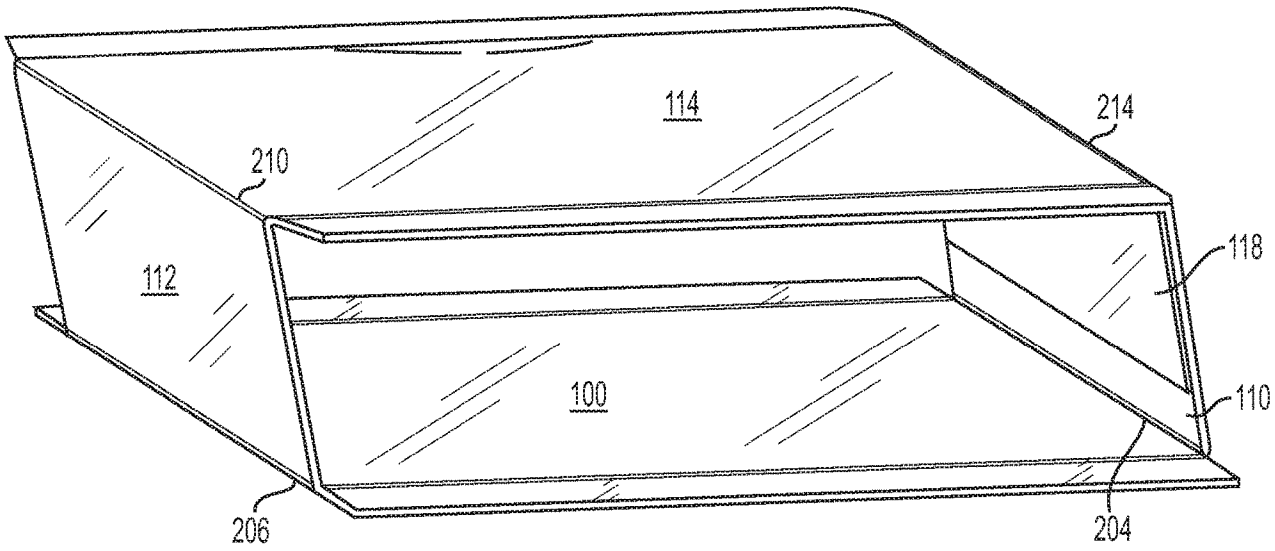
FIG. 3 is an illustration of the partially assembled outer packaging made from the blank of FIG. 2, in accordance with an example embodiment.
Figure 17:
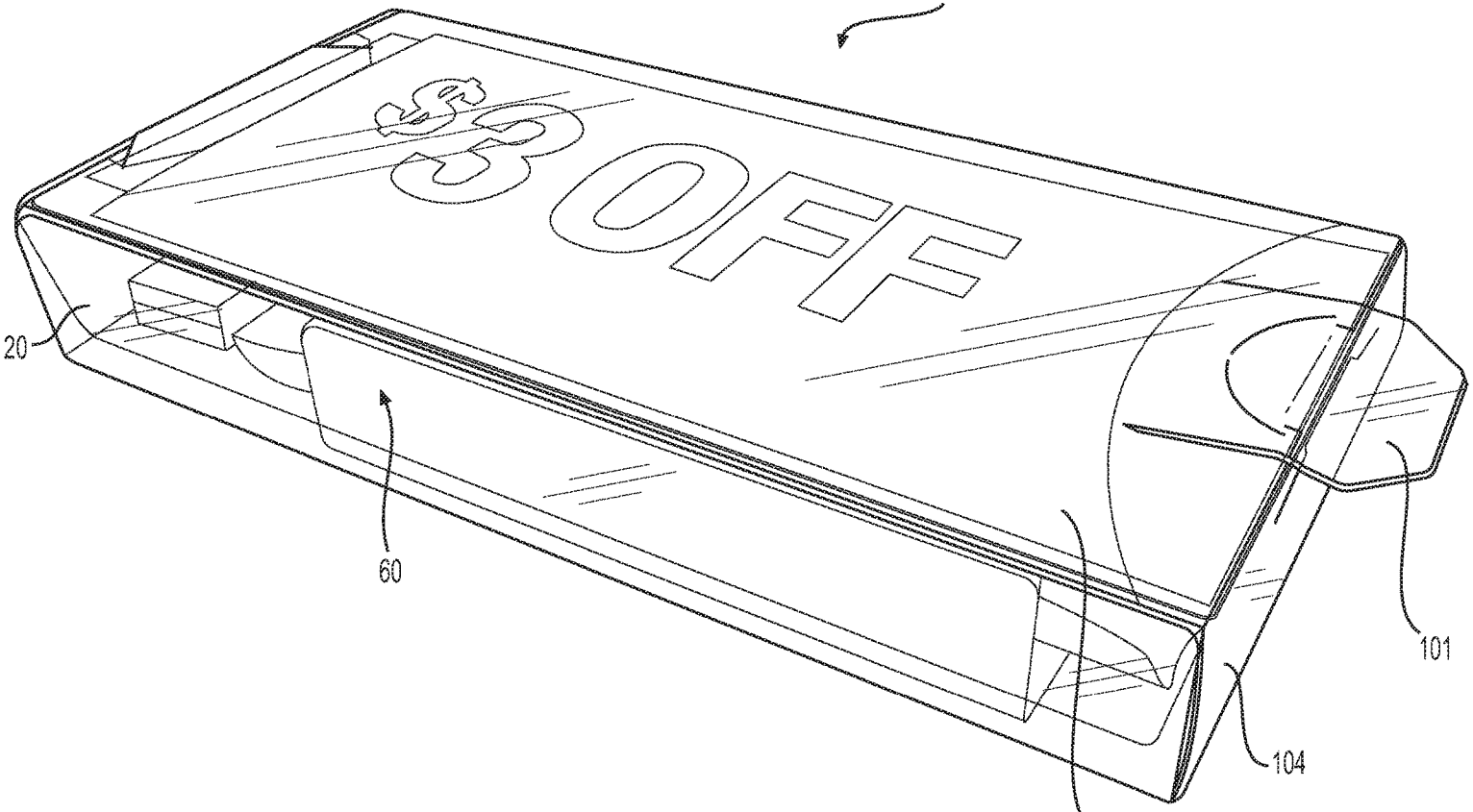
FIG. 17 is an illustration of the partially assembled e-kit that includes the manufacturing, advertisement and/or product information pamphlets, in accordance with an example embodiment.
Figure 18:
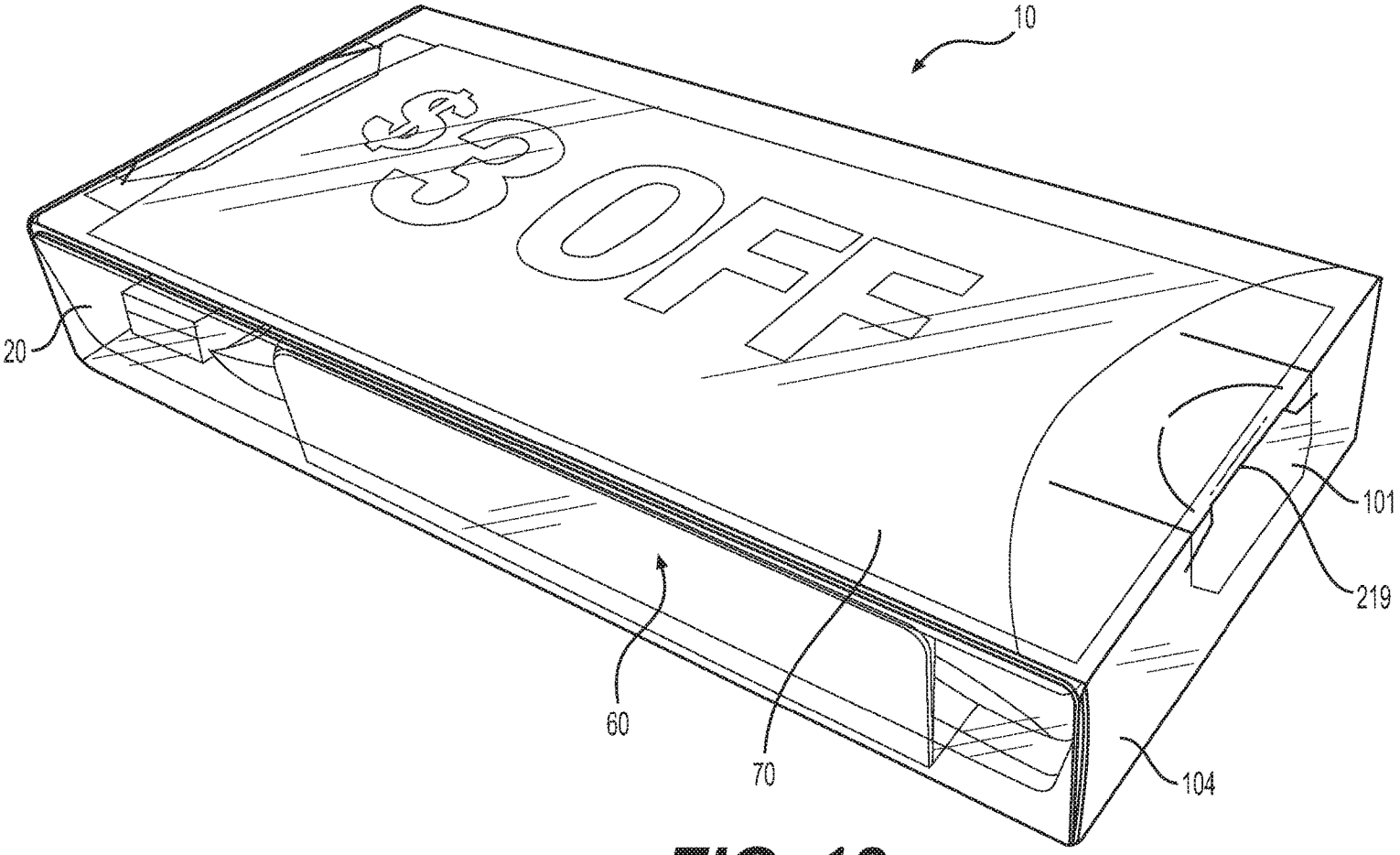
FIG. 18 is an illustration of the fully assembled and fully sealed e-kit that includes the manufacturing, advertisement and/or product information pamphlets, in accordance with an example embodiment.

FIG. 3 is an illustration of the partially assembled outer packaging 20 made from the blank 20*a* of FIG. 2, in accordance with an example embodiment. The outer packaging 20 is formed by folding the blank 20 at the fold lines 204, 206, 210 and 214 so that the front panel 100 and back panel 114 face each other. An adhesive such as glue, tape (such as pressure sensitive tape), a hot-melt adhesive, and/or another suitable bonding agent, may be applied to a front surface of the glue area 300 on the side glue panel 118 so that the front surface of the side glue panel 118 may be connected to the front surface of the side panel 110. The configuration of the outer packaging 20 is partially assembled, from the standpoint that each end of the outer packaging remains open. In order to fully close the outer packaging 20, the packaging 20 may be further folded at score lines 217 and the fourth fold line 208 in order to allow the front lower tuck panel 103 of the front panel 100 to be inserted into the back bottom slit 215 and the back lower slits 203 of the back panel 114, thereby closing the lower portion of the packaging 20. It is noted that the back lower slits 203 are angled upward on the back panel 114 so that the upper corners 103*a* of the front lower tuck panel 103 may "catch" within the slits 203 to slightly resist the front lower tuck panel 103 from being inadvertently removed from the back bottom slit 215 and the back lower slits 203. The packaging 20 may also be folded at the first and second fold lines 200/202 to allow the front upper tuck panel 102 to be tucked into the packaging (where a rear surface of the front upper tuck panel 102 may directly contact a rear surface of the back panel 114), as shown in FIG. 17. Once the front upper tuck panel 102 is tucked into the packaging, the back tuck panel 101 may be folded downward (i.e., folded along the back upper score line 211) so that the back tuck panel 101 may be inserted into the front upper slit 219 and front upper side slits 201, as shown in FIG. 18. It is noted that the front upper side slits 201 are angled downward on the front panel 100 so that the lower corners 101*a* of the back tuck panel 101 may "catch" within the front upper side slits 201 to slightly resist the back tuck panel 101 from being inadvertently removed from the front upper slit 219 and the front upper side slits 201.

Figure 4:
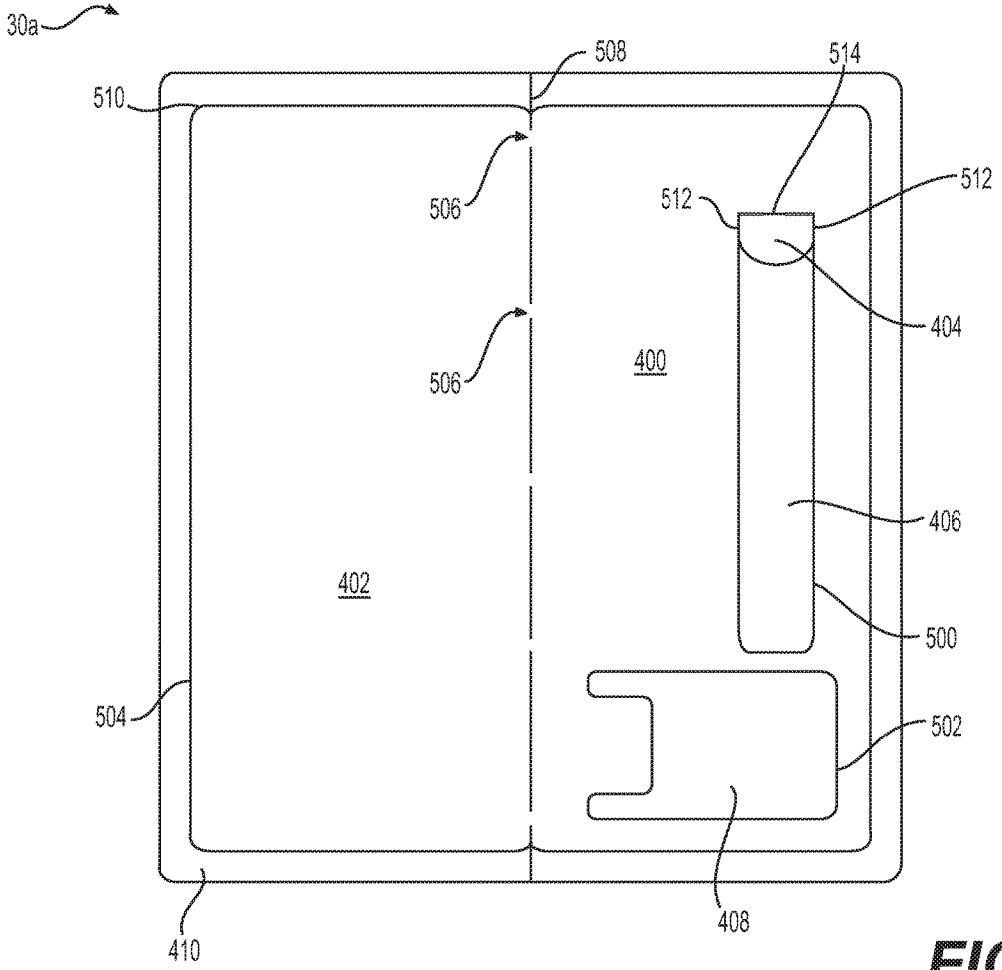
FIG. 4 is an illustration of a blank for forming a trap seal card for the e-kit, in accordance with an example embodiment.

FIG. 4 is an illustration of a blank 30*a* for forming a trap seal card 30 (see FIG. 11) for the e-kit 10, in accordance with an example embodiment. The blank 30*a* may be divided into two major portions: a front panel 400, and a back panel 402. The blank 30*a* may be made from thin paperboard that may be a single web of material. For instance, the blank 30*a* may be made from a 12 pt heat sealed board that may have a heat sealable adhesive on the rear surface. A number of slits 501 may be used to subdivide the front and back panels 400/402, where nicks 506 between the slits 501 help hold the panels 400/402 together. The front panel 400 may include a first cut-out area 406, where a first score line 500 may circumscribe the first cut-out area 406. The first cut-out area 406 may be in an approximate shape of a power section 50*b* of an e-vaping device. A flap 404 may be positioned near an upper end of the first cut-out area 406, where side slits 512 on either side of the flap 404 allow the flap 404 to extend from an upper surface of the front panel 400 when the trap seal card 30 is in use. An upper fold line 514 may allow the flap 404 to pivot and extend from the trap seal card 30 (shown in better detail in FIG. 11). The flap 404 may be considered a retaining structure that retains the element 50*b* within the first raised area 606.

The front panel 400 may also have a second cut-out area 408 that may be in an approximate shape of a USB charger 50*a* of an e-vaping device. A second scoring 502 of the front panel 400 may circumscribe the second cut-out area 408.

A third cut-out area 410 may border at least a portion of the front and back panels 400/402, where a cut line 504 may divide the front and back panels 400/402 from the third cut-out area 410. The front and back panels 400/402 may have rounded corners 510, where an indention 508 in the cut line 504 (where slits 501 intersect the cut line 504) may also be present.

Figure 5:
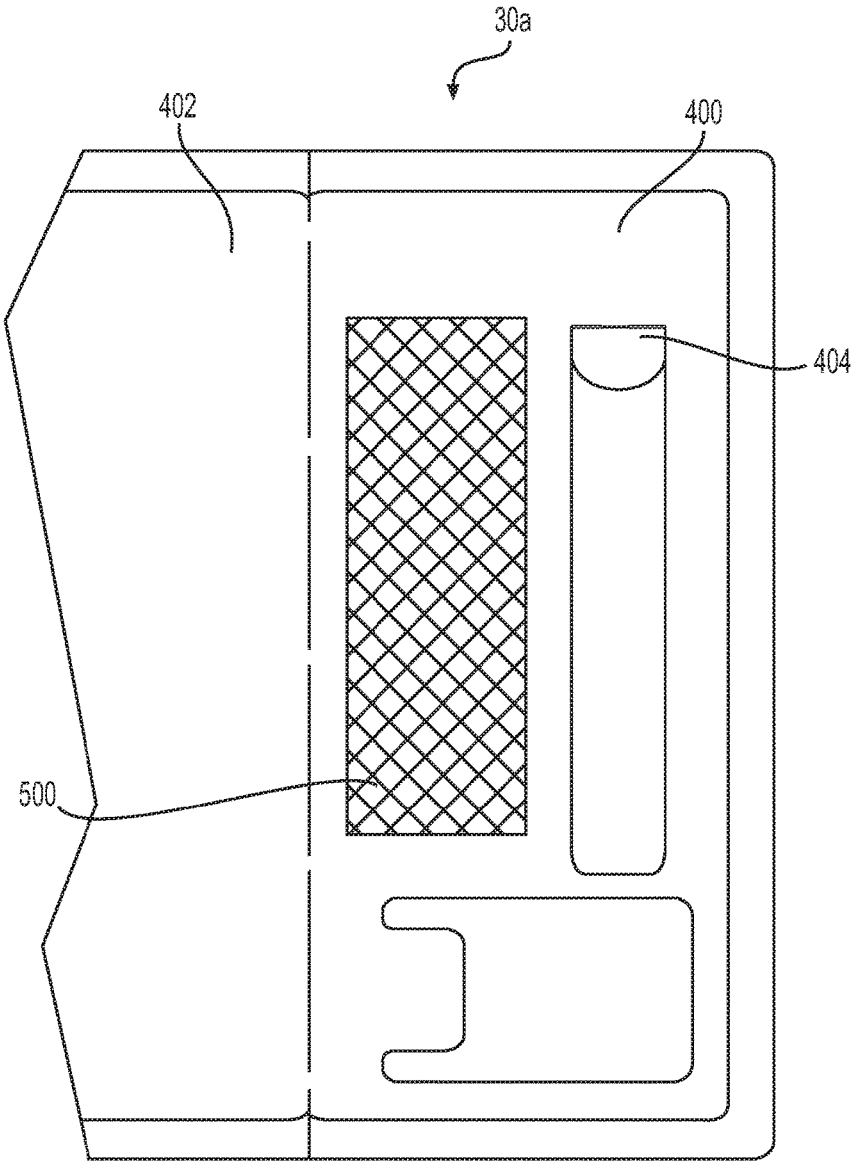
FIG. 5 is an illustration of a magnified view of a portion of the blank of FIG. 4, in accordance with an example embodiment.

FIG. 5 is an illustration of a magnified view of a portion of the blank 30*a* of FIG. 4, in accordance with an example embodiment. A glue area 500 may be provided on the front panel 400 of the blank 30*a*. An adhesive such as glue, tape (such as pressure sensitive tape), a hot-melt adhesive, and/or another suitable bonding agent, may be applied to the glue area 500 in order to connect the paperboard sleeve 40 (FIG. 10) to the front of the blank 30*a* during assembly of the trap seal card 30.

Figure 6:
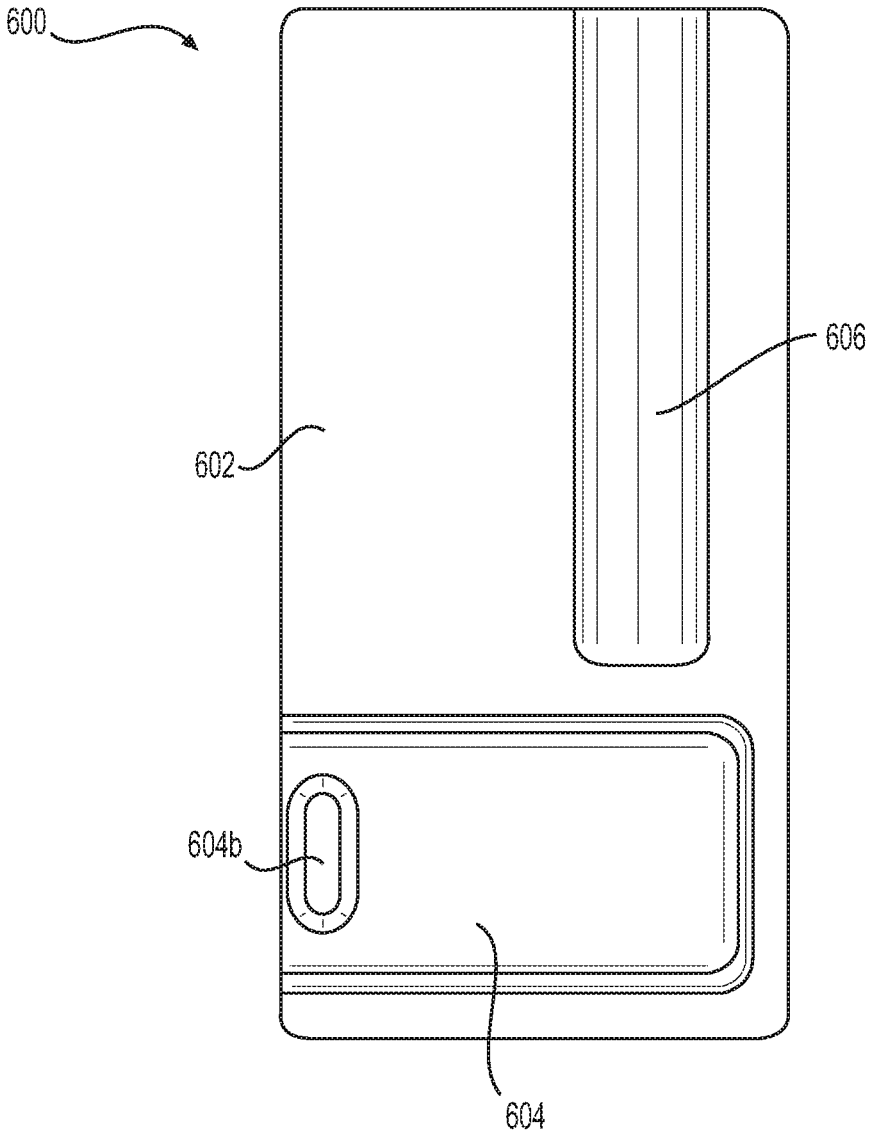
FIG. 6 is an illustration of a blister (plastic cover) for a front portion of the trap seal card of FIG. 4, in accordance with an example embodiment.

FIG. 6 is an illustration of a blister 600 for a front portion of the trap seal card 30, in accordance with an example embodiment. The blister 600 may be made from a transparent plastic material to allow the e-vaping elements 50*a*/*b* to be viewed through the front of the trap seal card 30. For instance, the blister 600 may be made from a clear moldable plastic that may, for instance, be 10 pt to 15 pt clear polyvinyl chloride (PVC). The blister 600 may include a first raised area 606 on a surface of a main panel 602 of the blister 600, where the first raised area 606 may be in a somewhat cylindrical shape. The blister 600 may also have a second raised area 604, where the second raised area 604 may be a somewhat rectangular shape. An indention 604*b* may be on an end of the second raised area 604.

Figure 7:
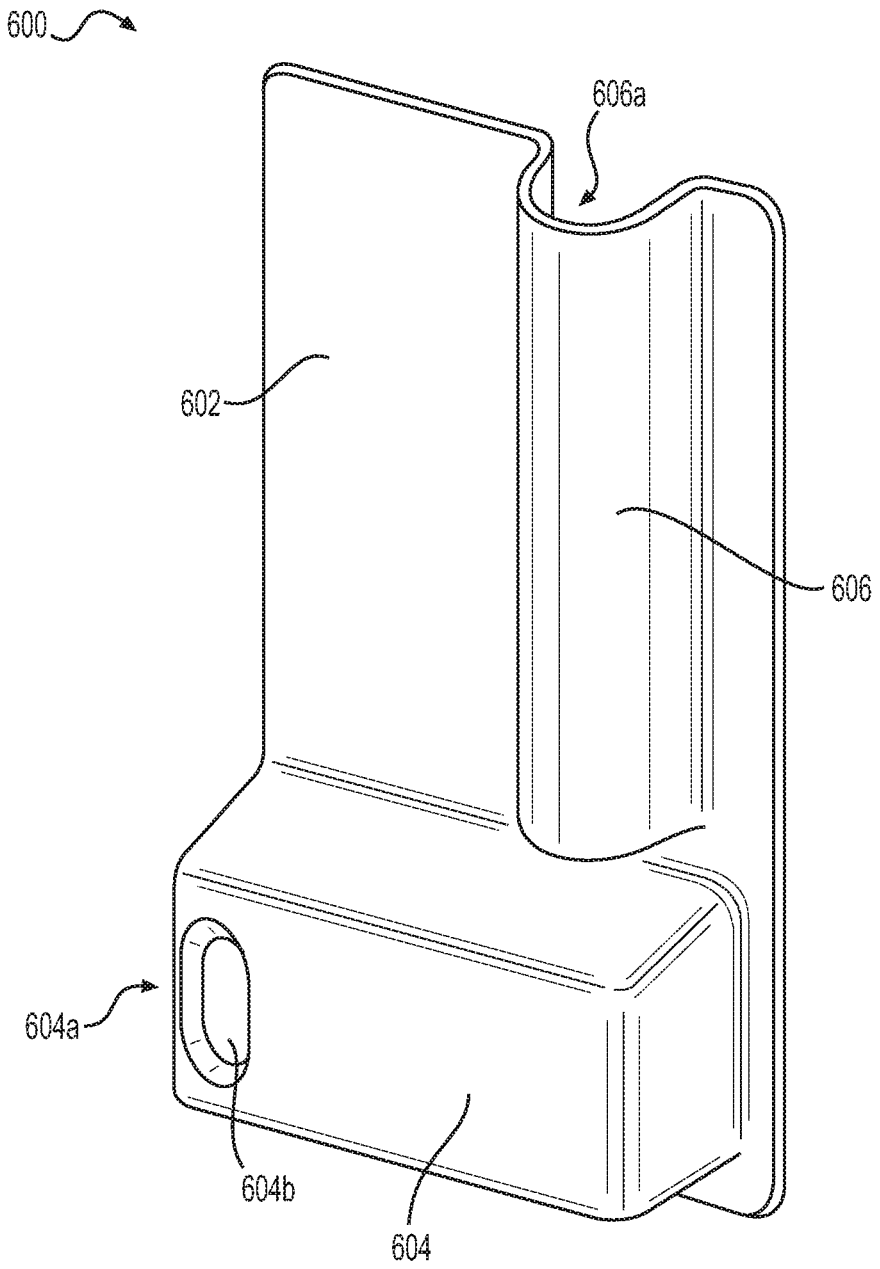
FIG. 7 is an illustration of a perspective view of the blister of FIG. 6, in accordance with an example embodiment.

FIG. 7 is an illustration of a perspective view of the blister 600 of FIG. 6, in accordance with an example embodiment. The blister 600 may include a first side opening 606*a* on an end of the first raised area 606. The blister 600 may also include a second side opening 604*a* on an end of the second raised area 604. These side openings 604*a*/606*a* may allow the e-vaping elements 50*a*/*b* to be inserted and extracted from the assembled trap seal card 30 (see FIG. 11).

Figure 11:
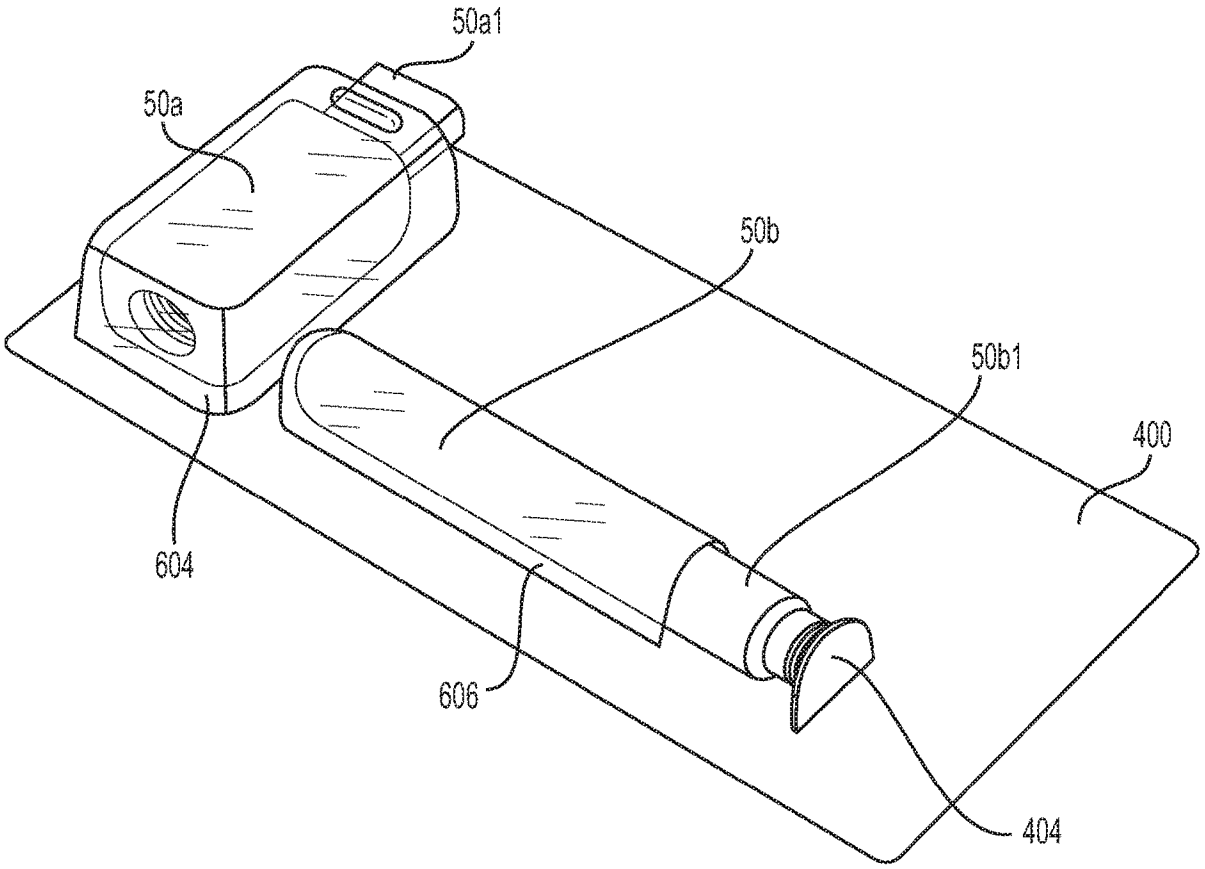
FIG. 11 is an illustration of an assembled trap seal card containing elements of an e-vaping device, in accordance with an example embodiment.

In order to assemble the trap seal card 30 (as shown in FIG. 11), the first and second cut-out areas of the blank 30*a* (see FIG. 4) for the trap seal card 30 may be removed and discarded, allowing the first and second raised areas 604/606 of the blister 600 to be inserted through the cut-out areas 406/408. The blank 30*a* may then be folded along the nicks and slits 506/501 so that a rear surface of the back panel 402 of the blank 30*a* may then be connected to a rear surface of the front panel 400 to seal the blister 600 within the assembled trap seal card 30 (see FIG. 11). Because the blank 30*a* may be made from a heat seal board with a heat sealable adhesive on the rear surface, heat may be applied to the folded blank 30*a* to melt the adhesive to keep the panels 400/402 of the trap seal card 30 together. The third cut-out area 410 may then be removed (along cut line 504) from the trap seal card 30, following the heat treatment of the trap seal card 30.

Figure 8:
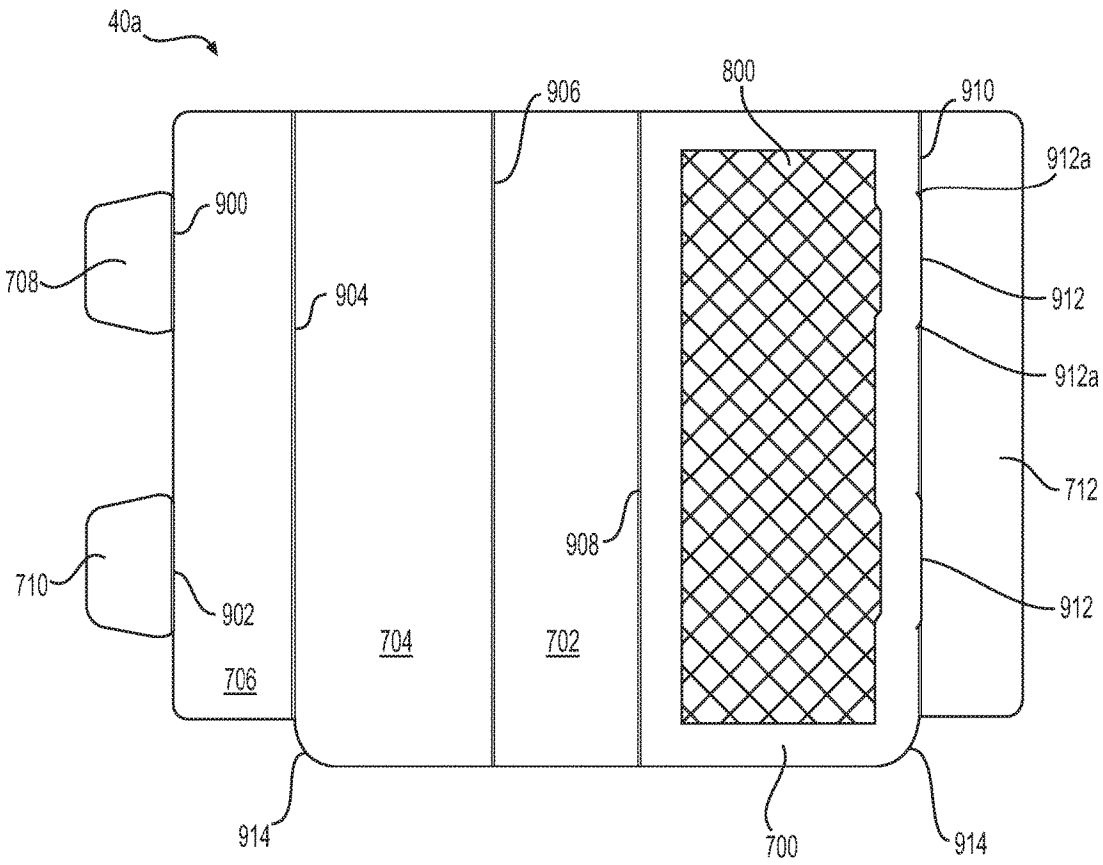
FIG. 8 is an illustration of a blank for forming a sleeve for the e-kit, in accordance with an example embodiment.

FIG. 8 is an illustration of a blank 40*a* for forming a sleeve 40 (FIG. 10) for the e-kit 10, in accordance with an example embodiment. The blank 40*a* may be made from thin paperboard, which may be a single web of material. For instance, the blank 40*a* may be made from 12 pt card stock. The blank 40*a* may include a back panel 700 that may include a glue area 800. There may be an intermediate panel 702 along a vertical side of the back panel 700, where a fifth fold line 908 may divide the intermediate panel 702 from the back panel 700. A front panel 704 may run along another vertical side of the intermediate panel 702, where a fourth fold line 906 may divide the front panel 704 from the intermediate panel 702. A left side panel 706 may run along another vertical side of the front panel 704, where a third fold line 904 may divide the left side panel 706 from the front panel 704. Two tongues 708/710 may extend from a free side of the left side panel 706, where first and second fold lines 900/902 may divide the tongues 708/710 from the left side panel 706.

A right side panel 712 may run along another vertical side of the back panel 700, where a sixth fold line 910 may divide the back panel 700 from the right side panel 712. Two side score lines 912 may run along the sixth fold line 910. The score lines 912 may be sized to accept the tongues 708/710 extending from the left side panel 706 when the blank 40*a* is assembled into the sleeve 40. The slits 912 may include inwardly curving slits 912*a* on ends of each of the slits 912, in order to allow a wide, proximal portion 708*a*/710*a* of the tongues 708/710 to be retained within the slits 912, so that the tongues 708/710 may not be inadvertently removed from the slits 912 once the sleeve 40 is assembled. The lower ends of the left side panel 706 and right side panel 712 may be offset 914 (e.g., the left and right side panels 706/712 may not be as long as the front panel 704, the intermediate panel 702 and the back panel 700), in order to allow the e-vaping element 50*c* to be more easily viewed from a side of the trap seal card 30 (see the extra viewing area 40*b* of the sleeve 40 caused by the offset 914, in FIG. 14).

Figure 9:
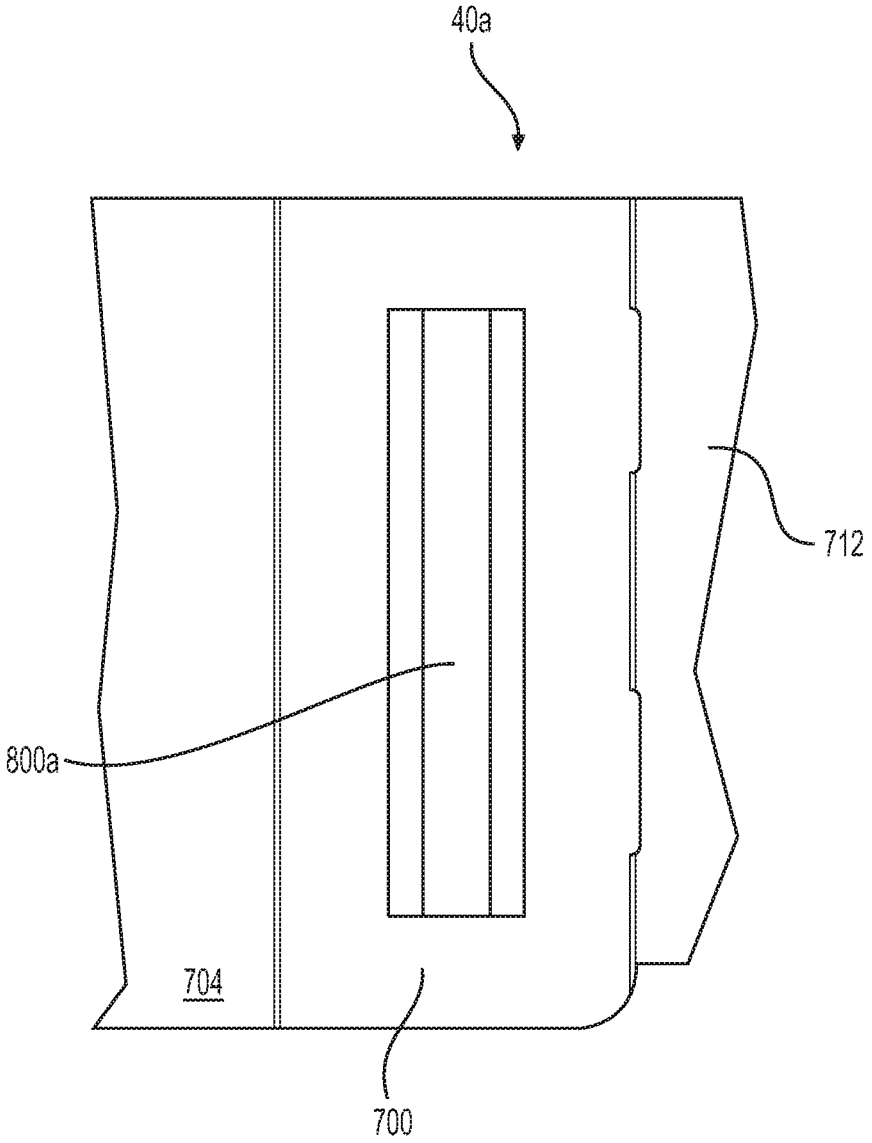
FIG. 9 is an illustration of a magnified view of a portion of the blank of FIG. 8, in accordance with an example embodiment.

FIG. 9 is an illustration of a magnified view of a portion of the blank 40*a* of FIG. 8, in accordance with an example embodiment. A pressure sensitive tape 800*a* may be applied to the front surface of the back panel 700. Alternatively, a suitable adhesive, a hot-melt adhesive, and/or another bonding agent, may be applied to this front surface of the back panel 700 to assemble the sleeve 40. The tape 800*a* (and/or adhesive in the glue area 800) may be used to connect the sleeve 40 to the glue area 500 of the trap seal card 30.

Figure 10:
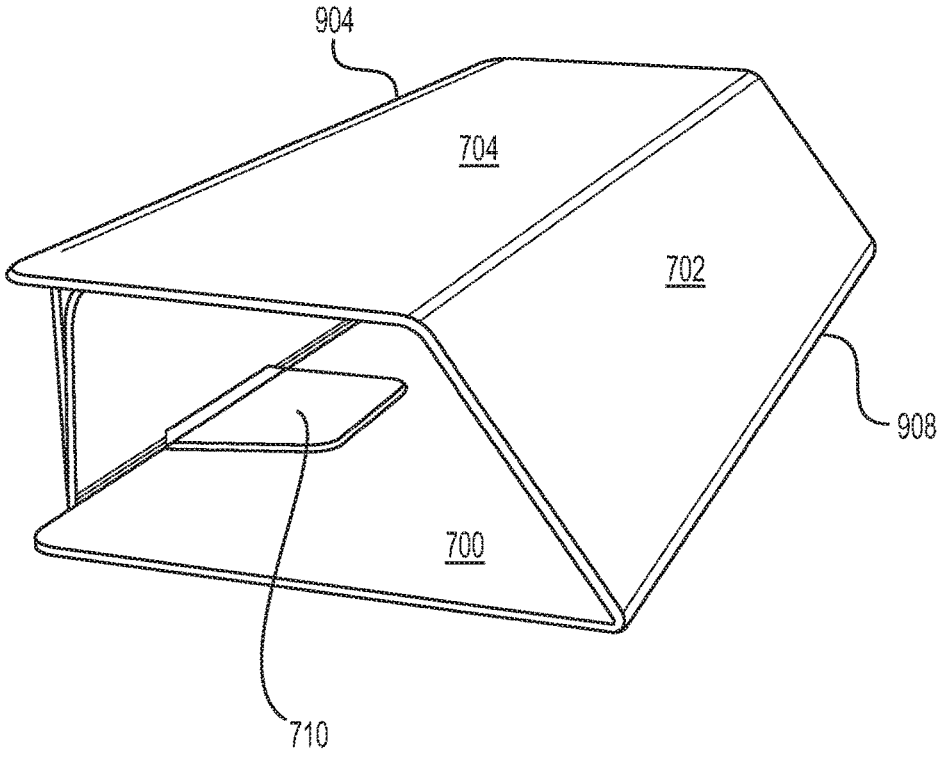
FIG. 10 is an illustration of an assembled sleeve made from the blank of FIG. 8, in accordance with an example embodiment.

FIG. 10 is an illustration of an assembled sleeve 40 made from the blank 40*a* of FIG. 8, in accordance with an example embodiment. The sleeve 40 may be folded along the first fold line 900, the second fold line 902, the third fold line 904, the fourth fold line 904, the fifth fold line 908 and the sixth fold line 910 so that the tongues 708/710 may be inserted through the slits 912 to form the sleeve 40 that may have a trapezoidal-shaped cross-section (as shown in FIG. 10).

FIG. 11 is an illustration of an assembled trap seal card 30 containing elements of an e-vaping device 50*a*/50*b*, in accordance with an example embodiment. As shown in FIG. 11, an exposed end 50*a*1 of a USB charger 50*a* of an e-vaping device may extend from the second side opening 604*a* of the second raised area 604 of the blister 600 (also see FIG. 7). An exposed end 50*b*1 of a power section 50*b* of an e-vaping device may also extend from the first opening

606*a* of the first raised area 606 of the blister (also see FIG. 7). The exposed ends 50*a*1/50*b*1 of the e-vaping elements 50*a/b* on the trap seal card 30 may allow the e-vaping elements 50*a/b* to be conveniently removed from a front surface of the trap seal card 30 (rather than requiring the elements 50*a/b* to be pushed through a back of the trap seal card 30), thereby allowing quick access to the elements 50*a/b* once the trap seal card 30 is removed from the outer packaging (as shown for instance, in FIG. 16).

Figure 16:
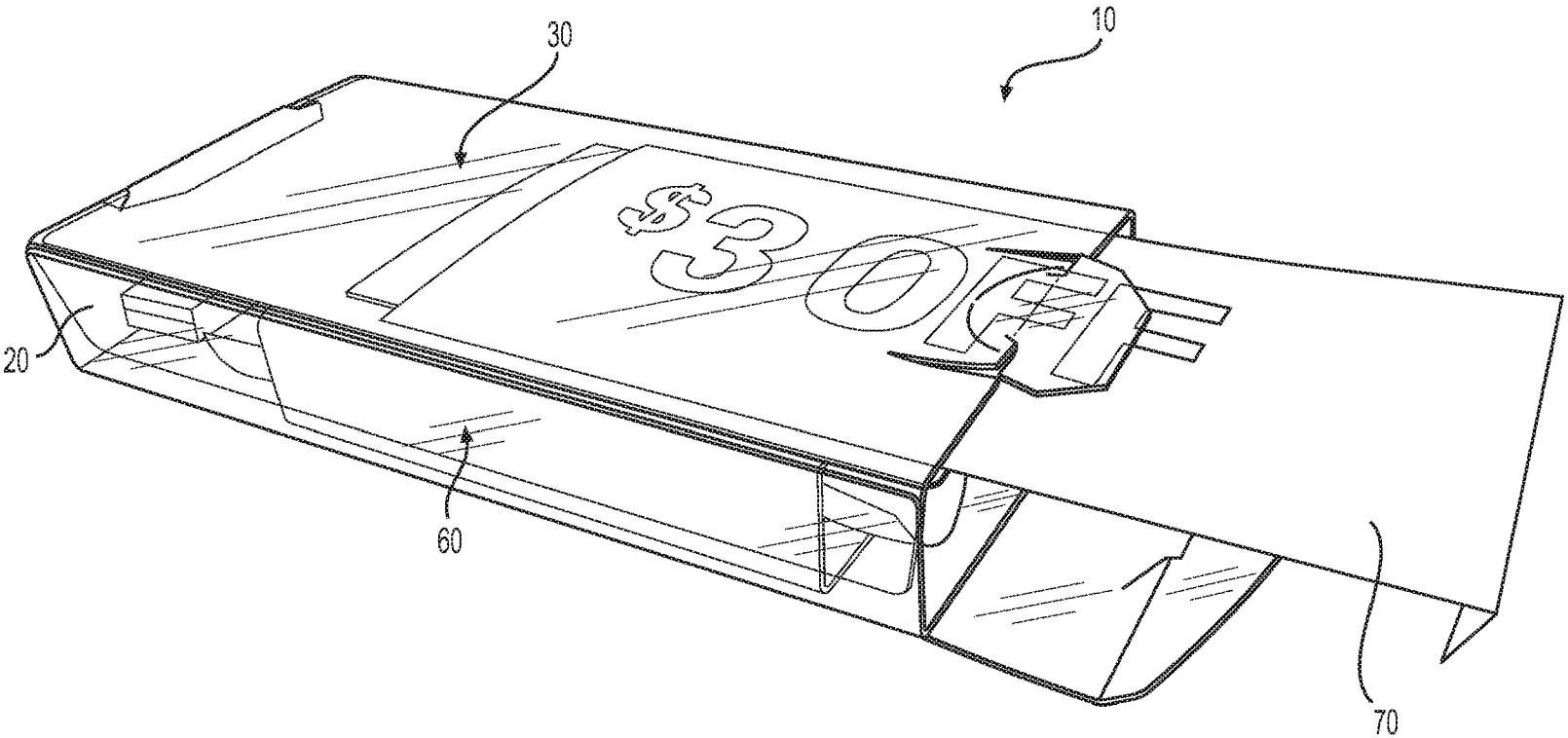
FIG. 16 is an illustration of manufacturing, advertisement and/or product information pamphlets being slid into the e-kit, in accordance with an example embodiment.

The flap 404 of the trap seal card 30 may project away from a front panel 400 of the trap seal card 30 in order to help retain the e-vaping element 50*b* in the first raised portion 606 of the trap seal card 30, even after the trap seal card 30 is initially removed from the outer packaging 20 (as shown in FIG. 16). The indention 604*b* in the second raised portion 604 of the trap seal card 30 may also hold and retain an edge of the e-vaping element 50*a* in order to help retain the e-vaping element 50*a* in eth second raised portion 604 of the trap seal card 30, even after the trap seal card 30 is initially removed from the outer packaging 20 (as shown in FIG. 16).

Figure 12:
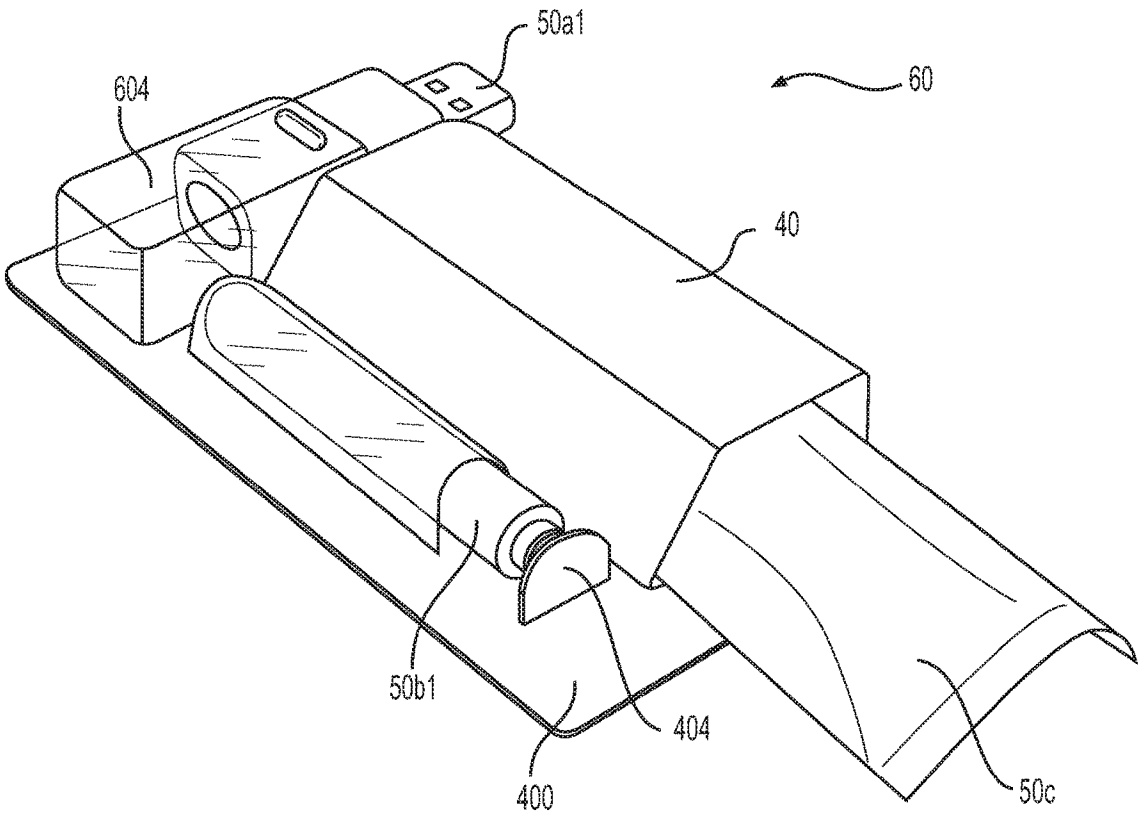
FIG. 12 is an illustration of the sleeve connected to the trap seal card that forms the inner packaging of the e-kit, in accordance with an example embodiment.

FIG. 12 is an illustration of the sleeve 40 connected to the trap seal card 30 that forms the inner packaging 60 of the e-kit 10, in accordance with an example embodiment. In this embodiment, the sleeve 40 may be connected to the front panel 400 of the trap seal card 30 using the adhesive, tape and/or boding material that may be applied to the glue area 500 of the trap seal card 30 and the glue area 800 of the sleeve 40. As shown in FIG. 12, the element 50*a* may be removed from the second raised area 604 of the card 30 by pulling the exposed end 50*a*1 of the element 50*a* through the second side opening 604*a* (FIG. 7) so that an edge 50*a*2 of the element 50*a* may clear the indention 604*b* that helps retain the element 50*a* in the trap seal card 30. In an embodiment, the trap seal card 30 may contain enough e-vaping elements 50*a*, 50*b* and 50*c* to be assembled into at least one complete e-vaping device (that may include a power section 50*b*, a cartridge in a pouch 50*c*, and a USB charger 50*a* for the device).

Figure 13:
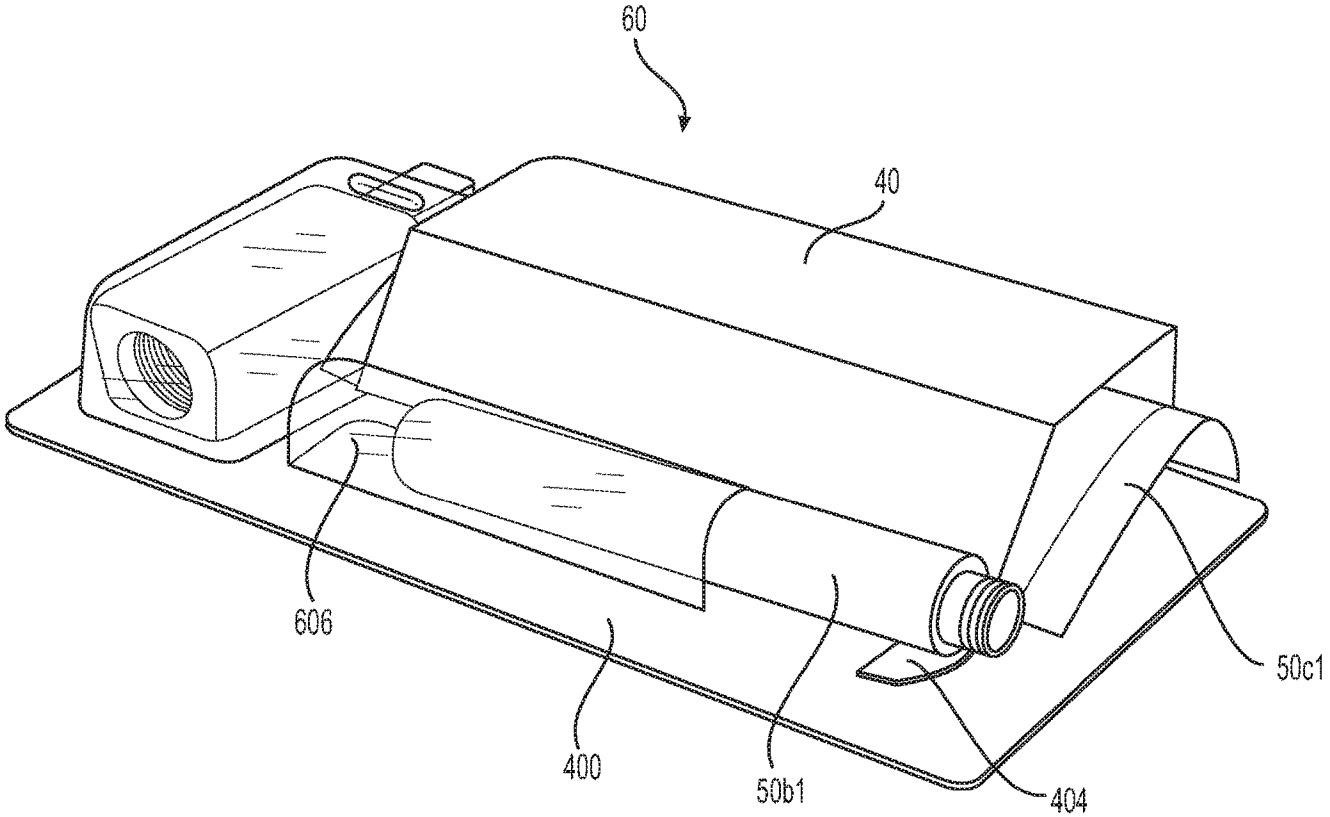
FIG. 13 is an illustration of another view of the inner packaging of FIG. 12, where an element of the e-vaping device is being removed from a front of the trap seal card, in accordance with an example embodiment.

FIG. 13 is an illustration of another view of the inner packaging 60 of FIG. 12, where an element 50*b* of the e-vaping device is being removed from a front of the trap seal card 30, in accordance with an example embodiment. Specifically, the exposed end 50*b*1 of the element 50*b* may be pulled from the first raised area 606 of the trap seal card 30, while the flap 404 is allowed to be pressed toward the front panel 400 to free the element 50*b*. Also, in this example embodiment, a foil pouch 50*c* containing a consumable (perishable) element of an e-vaping device may be inserted into the sleeve 40.

Figure 14:
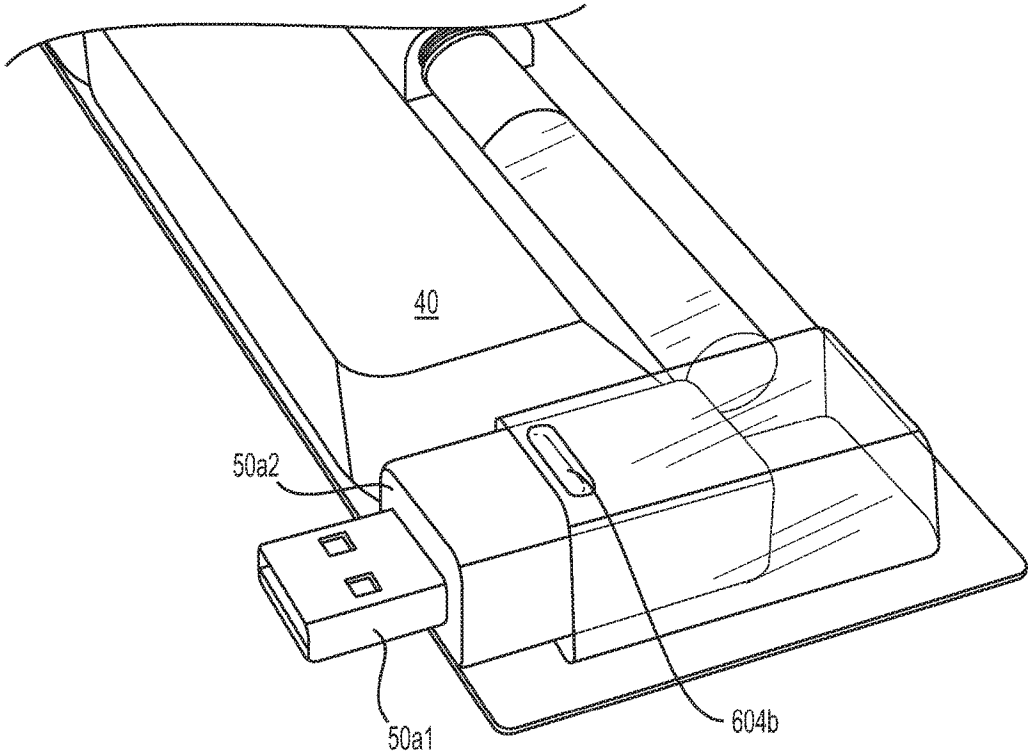
FIG. 14 is an illustration of another view of the inner packaging of FIG. 12, where another element of the e-vaping device is being removed from a front of the trap seal card, in accordance with an example embodiment.

FIG. 14 is an illustration of another view of the inner packaging 60 of FIG. 12, where another element 50*a* of the e-vaping device is being removed from a front of the trap seal card 30, in accordance with an example embodiment. Specifically, FIG. 14 shows the edge 50*a*2 of the element 50*a* being freed from the indention (tab) 604*b* of the second raised area 604 as the exposed end 50*a*1 of the element 50*a* is pulled out of the front of the trap seal card 3. The indention (tab) 604*b* may be considered a retaining structure that retains the element 50*a* within the second raised area 604. FIG. 14 also shows the viewing area 40*b* of the sleeve 40 that is created by the offset 914 of the left side panel; 706 and right side panel 712 of the sleeve 40 (also see FIG. 8).

Figure 15:
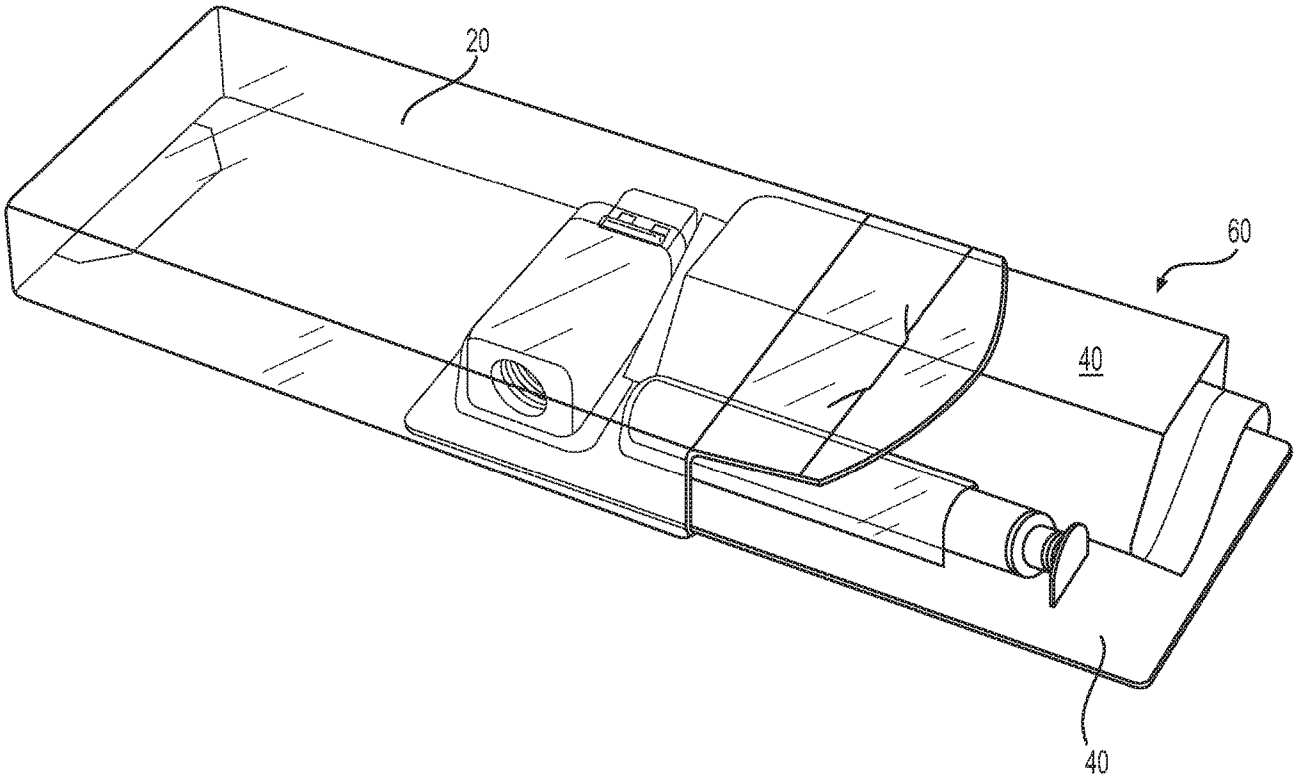
FIG. 15 is an illustration of the inner packaging being slid into the outer packaging of the e-kit, in accordance with an example embodiment.

FIG. 15 is an illustration of the inner packaging 60 being slid into the outer packaging 20 of the e-kit 20, in accordance with an example embodiment. Because the outer packaging 20 may be transparent, the inner packaging 60 may easily be seen while inside the outer packaging 20. Further, because at least a portion 50*a*1, 50*b*1 and 50*c*1 of each of the e-vaping elements 50*a*, 50*b* and 50*c* may be viewed on a front of the trap seal card 30, these same elements 50*a*, 50*b* and 50*c* may therefore be seen once the outer packaging 2 fully envelopes the inner packaging 60. Furthermore, due to the convenience and self-contained nature of the inner packaging 60, the inner packaging 60 and the trap seal card 30 may be extracted (i.e., slid) from inside the outer packaging 20 via one simple, unobstructed motion that may involve pulling on one end 60*a* of the inner packaging 60 to pull the inner packaging 60 through an open end of the outer packaging 20. Once the inner packaging 60 has been extracted from the outer packaging 20 in one simple unobstructed motion, the e-vaping elements 50*a*, 50*b* and 50*c* may also conveniently be removed from a single, front side the inner packaging 60, by grasping exposed ends 50*a*1, 50*b*1 and 50*c*1 of the e-vaping elements 50*a*, 50*b* and 50*c*, and pulling the e-vaping elements 50*a*, 50*b* and 50*c* from the front of the inner packaging 60 (as opposed to being forced to press the elements 50*a*, 50*b* and 50*c* through the back of the inner packaging 60, pressing the elements 50*a*, 50*b* and 50*c* though a blister, or otherwise pressing the elements 50*a*, 50*b* and 50*c* through any material in order to extract the elements 50*a*, 50*b* and 50*c* from the trap seal card 30 or the inner packaging 60).

FIG. 16 is an illustration of manufacturing, advertisement and/or product information pamphlet(s) 70 being slid into the e-kit 10, in accordance with an example embodiment. For instance, the pamphlet(s) 70 may be inserted between a back of the inner packaging 60 and a wall of the outer packaging 20.

FIG. 17 is an illustration of the partially assembled e-kit 10 that includes the manufacturing, advertisement and/or product information pamphlet(s) 70, in accordance with an example embodiment. In this embodiment, the front upper tuck panel 102 may be tucked into the outer packaging 20 so that a front surface of the front upper tuck panel 102 is contacting a rear surface of the top portion of the back panel 114. In this configuration, the back tuck panel 101 is left extended, such that the tuck panel 101 has not yet been tucked into the slit 219 of the front panel 100.

FIG. 18 is an illustration of the fully assembled and fully sealed e-kit 10 that includes the manufacturing, advertisement and/or product information pamphlets, in accordance with an example embodiment. In this configuration, the tuck panel 101 is tucked into the slit 219 of the front panel 100, such that the e-kit 10 is fully sealed in this embodiment.

FIG. 19 is an illustration of an "opened" top end of the e-kit 10, in accordance with an example embodiment. In this embodiment, the upper portion 114*a* of the outer packaging 20 may act as a "tear open" portion of the packaging 20. Specifically, the upper portion 114*a* may be pressed inward in order to tear the upper portion 114*a* from the remainder of the back panel 114, along slits 216, so that the upper portion 114*a* and the back tuck panel 101 may remain stuck in slit 219 of the front upper panel 104 and front upper tuck panel 102. The "tearing" of the upper portion 114*a* may provide tamper resistance for the e-kit 10, in order to indicate that the e-kit 10 has been opened, as the lower corners 101*a* of the back tuck panel 101 do not otherwise allow the back tuck panel 101 to be removed from the slit 219 of the front panel 100 once the e-kit 10 has been fully assembled and sealed (due to the front upper side slits 201 retaining the lower corners 101*a* of the back tuck panel 101).

Figure 20:
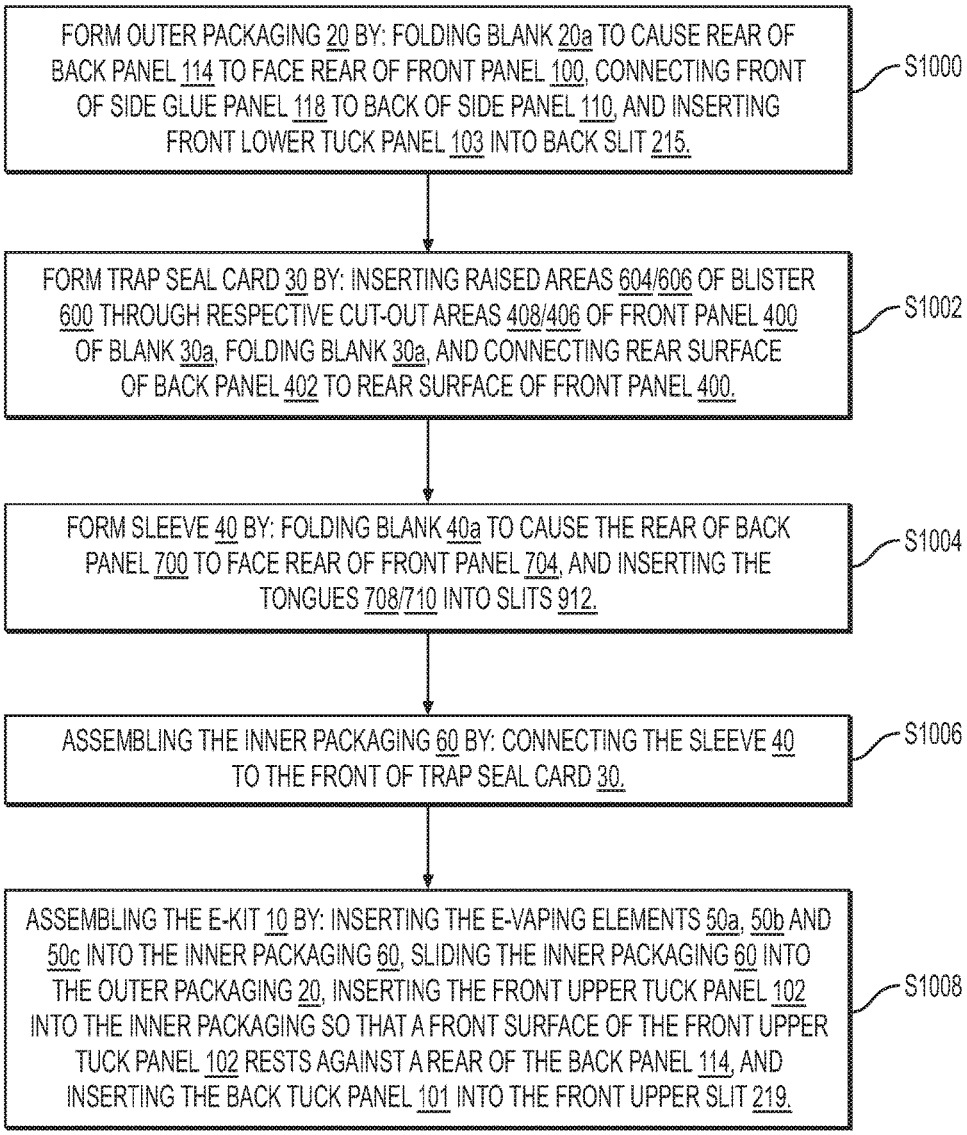
FIG. 20 is a method flowchart detailing steps for forming the e-kit, in accordance with an example embodiment.

FIG. 20 is a method flowchart detailing steps for forming the e-kit 10, in accordance with an example embodiment. In step S1000, the outer packaging 20 of the e-kit 10 may be formed by folding the blank 20*a* (FIG. 2) to cause the rear surface of back panel 114 to face the rear surface of front panel 100 (by folding on the fold third fold line 204, the fifth fold line 206, the sixth fold line 210 and the seventh fold line 214). The front surface of side glue panel 118 may then be connected to the rear surface of the side panel 110 via the use of an adhesive, glue, and/or tape (as described above). The front lower tuck panel 103 of the front panel 100 may then be slid into the back bottom slit 215 of the back panel 114 to close a bottom end of the package 20.

In step S1002, the trap seal card 30 may be formed by inserting the raised areas 604/606 of blister 600 (FIGS. 6 and 7) through the respective cut-out areas 408/406 of the front panel 400 of blank 30*a* (FIG. 4). The blank 30*a* may then be folded so that the rear surface of the back panel 402 is connected to the rear surface of the front panel 400, whereupon heat may be applied to the folded blank 30*a* to melt an adhesive on a rear surface of the blank 30*a* to connect the back panel 402 to the front panel 400.

In step S1004, the sleeve 40 may be formed by folding blank 40*a* in order to cause the rear surface of the back panel 700 to face the rear surface of the front panel 704 (by folding the blank 40*a* along the third fold line 904, the fourth fold line 906, the fifth fold line 908 and the sixth fold line 910). The tongues 708/710 may then be inserted into respective slits 912 to erect the sleeve 40 (as shown in FIG. 10).

In step S1006, the inner packaging may be assembled by connecting the front surface of the back panel 700 of the erected sleeve 40 (FIG. 10) to the front of the trap seal card 30 (see FIG. 11). In particular, the front surface of the back panel 700 of the erected sleeve 40 may be connected to the front panel 400 (see FIGS. 4 and 11) of the assembled trap seal card 30, where adhesive, glue and/or tape (as described above) may be used to adhere the sleeve 40 to the trap seal card 30.

In step S1008, the e-kit 10 may be assembled by inserting e-vaping elements 50*a*, 50*b* and 50*c* into the inner packaging 60 (as shown in FIG. 12). The inner packaging 60 may then be slid into the outer packaging 20 (as shown in FIG. 15). The front upper tuck panel 102 of the front panel 100 of the outer packaging 20 may then be inserted into the inner packaging so that a front surface of the tuck panel 102 rests against a back surface of an upper portion of the back panel 114 in order to seal a top end of the outer packaging 20 (as shown in FIG. 17). The back tuck panel 101 of the back panel 114 of the outer packaging 20 may then be inserted into the front upper slit 219 of the front panel 100 of the outer packaging 20 in order to fully seal the outer packaging 20.

Dimensional Information:

An overall height of the blank 20*a* (FIG. 2) for erecting the outer packaging 20 may be about 174 mm (from a top of front upper tuck panel 102 to a bottom of front lower tuck panel 103), and an overall width of the blank 20*a* may be about 156.5 mm (from an end of the side panel 110 to an end of side glue panel 118). When erected, the outer packaging may be about 118 mm long, 55 mm wide, and 17 mm deep. A width of the front panel 400 of the blank 30*a* for forming the trap seal card 30 may be about 53 mm, and the front panel 400 may be about 117 mm long (where the back panel 402 may have the same dimensions). Therefore, the erected trap seal card 30 may also be about 117 mm long and 53 mm wide. The blister 600 may be about 83 mm long and 40.5 mm wide. The blank 40*a* (FIG. 8) for the sleeve 40 may be about 75 mm in length (i.e., this is the length of the front panel 704, for instance) and 107.25 mm in width (from the ends of tongues 708/710 to the end of the right side panel 712). The erected sleeve 40 (FIG. 10) may therefore have a length of about 75 mm.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. An e-kit, comprising:

outer packaging defining an inner cavity, the outer packaging being transparent;

inner packaging within the inner cavity, the inner packaging including, a trap seal card, and at least two e-vaping elements contained on a single, first side of the trap seal card, the first side of the trap seal card facing a first front panel of the outer packaging, the first side of the trap seal card being configured to display an exposed portion of the at least two e-vaping elements, wherein the at least two e-vaping elements can be assembled to make at least one complete e-vaping device, the trap seal card further including, at least first and second raised areas on the first side of the trap seal card that each contain one of the at least two e-vaping elements, wherein the trap seal card further includes, first and second retaining structures that are each configured to retain a part of the exposed portion of the at least two e-vaping elements, and a sleeve connected to the first side of the trap seal card, the sleeve containing a pouch, wherein the at least two e-vaping elements includes the pouch.

2. The e-kit of claim 1, wherein the trap seal card being configured to be extracted from the outer packaging in one unobstructed motion, once an upper end of the outer packaging is opened, the trap seal card being further configured to allow the exposed portion of the at least two e-vaping elements to be grasped in order to remove the at least two e-vaping elements from a front of the first side of the trap seal card without a need for the at least two e-vaping elements to be pressed through any material on the trap seal card.

3. The e-kit of claim 2, wherein the trap seal card is made, in part, from a first blank that is a single web of a first material, the first blank including, a first front panel defining at least a first cut-out area and a second cut-out area, wherein a flap is connected to an end of the first cut-out area along a first fold line, the flap being the first retaining structure, a first back panel connected along a vertical side of the first front panel, the single web of the first material being a heat sealed board with a heat sealable adhesive on a rear surface of the first front panel and the first back panel.

4. The e-kit of claim 3, wherein the trap seal card further includes, a blister made from a transparent material, a major portion of the blister being sealed between the first front panel and the first back panel of the trap seal card via the heat sealable adhesive, another portion of the blister forming the at least first and second raised areas of the trap seal card, and the at least first and second raised areas project through the first and second cut-out areas of the first front panel of the trap seal card, the second raised area of the blister including an inwardly facing indention that is the second retaining structure.

5. An e-kit, comprising:

outer packaging defining an inner cavity, the outer packaging being transparent;

inner packaging within the inner cavity, the inner packaging including, a trap seal card, at least one first e-vaping element contained on a single, first side of the trap seal card, the first side of the trap seal card facing a first front panel of the outer packaging, the first side of the trap seal card being configured to display an exposed portion of the at least one first e-vaping element, wherein the outer packaging of the e-kit is a box structure, the box structure being made from a single web of a first material, the box structure including, a second front panel and a second back panel, a first side formed by an intermediate panel that is connected to the second front panel and the second back panel, a second side that is sealed by a first adhesive, the first adhesive connecting a rear surface of a side panel to a front surface of a side glue panel, the side panel connected to the second front panel and the side glue panel connected to the second back panel, a lower end formed by a front lower panel connected to a lower portion of the first front panel and a back lower panel connected to a lower portion of the second back panel, an upper end formed by a front upper panel that is connected to an upper portion of the second front panel, the upper end being sealed by a front upper tuck panel tucked into the outer packaging so that a front surface of the front upper tuck panel contacts an upper portion of the second back panel, the front upper tuck panel being connected to the front upper panel, the upper end being further sealed by a back tuck panel connected to an upper portion of the second back panel retained in a front upper slit that is defined by the front upper panel and the front upper tuck panel.

6. The e-kit of claim 5, wherein, the front upper panel further defines a pair of front upper side slits on sides of the front upper slit that are diagonally oriented relative to a longitudinal length of the front upper panel, and the back tuck panel defines a pair of back top slits with downturned corners below respective lower corners of the back tuck panel, each of the front upper side slits being configured to retain the lower corners of the back tuck panel and resist the back tuck panel from being able to be backed out of the front upper slit, and the upper portion of the second back panel is at least partially circumscribed by arcuate slits defined by the second back panel, the upper portion being configured to be depressed so that the upper portion and the back tuck panel can be torn away from the second back panel in order to allow the upper end of the outer packaging to be opened and provide an indication of tampering of the outer packaging.

7. The e-kit of claim 5, wherein the box structure is made from a second blank that is the single web of the first material, the second blank including, the second front panel connected to the second back panel via the intermediate panel, the front upper panel connected to a top portion of the second front panel along a first fold line, a front upper tuck panel connected to a top portion of the front upper panel along a second fold line, the side panel connected to a first side of the second front panel along a third fold line, the front lower panel connected to a lower portion of the second front panel along a fourth fold line, the intermediate panel connected to a second side of the second front panel along a fifth fold line, the intermediate panel connected to a first side of the second back panel along a sixth fold line, the side glue panel connected to a second side of the second back panel along a seventh fold line, the back tuck panel extending from the upper portion of the second back panel, wherein the front upper panel and front upper tuck panel define a front upper side slit configured to retain the back tuck panel, the front upper panel further defines a pair of front upper side slits on sides of the front upper slit that are diagonally oriented relative to a longitudinal length of the front upper panel, the back tuck panel defines a pair of back top slits with downturned corners, each back top slit being below one of the lower corners of the back tuck panel, and the front upper side slits are configured to retain the lower corners of the back tuck panel and resist the back tuck panel from being able to be backed out of the front upper slit once the back tuck panel has been inserted into the front upper slit.

* * * * *